US010307339B2

(12) United States Patent
Horn

(10) Patent No.: US 10,307,339 B2
(45) Date of Patent: Jun. 4, 2019

(54) MULTI-COMPARTMENT MEDICINE STORAGE AND DISPENSING CONTAINER

(71) Applicant: Kimberlee Ann Horn, Crawfordsville, IN (US)

(72) Inventor: Kimberlee Ann Horn, Crawfordsville, IN (US)

( * ) Notice: Subject to any disclaimer, the term of this patent is extended or adjusted under 35 U.S.C. 154(b) by 59 days.

(21) Appl. No.: 15/148,376

(22) Filed: May 6, 2016

(65) Prior Publication Data

US 2016/0324725 A1 Nov. 10, 2016

Related U.S. Application Data

(60) Provisional application No. 62/157,632, filed on May 6, 2015.

(51) Int. Cl.

| | |
|---|---|
| ***B65D 69/00*** | (2006.01) |
| ***B65D 71/00*** | (2006.01) |
| ***A61J 7/04*** | (2006.01) |
| ***A61J 7/00*** | (2006.01) |
| ***B65D 25/04*** | (2006.01) |
| ***B65D 43/16*** | (2006.01) |
| ***B65D 25/20*** | (2006.01) |

(52) U.S. Cl.

CPC ..... *A61J 7/04* (2013.01); *A61J 7/0069* (2013.01); *A61J 7/0084* (2013.01); *B65D 25/04* (2013.01); *B65D 25/205* (2013.01); *B65D 43/16* (2013.01); *A61J 2200/30* (2013.01); *A61J 2205/30* (2013.01)

(58) Field of Classification Search

CPC ..... A61J 7/04; A61J 7/0069; A61J 7/0084; A61J 2200/30; A61J 2205/30; B65D 25/04; B65D 25/205; B65D 43/16

USPC ..... 206/570, 223, 371, 534, 538, 214; 221/92, 98, 282, 303

See application file for complete search history.

(56) References Cited

U.S. PATENT DOCUMENTS

| | | | | |
|---|---|---|---|---|
| 4,253,572 | A | 3/1981 | Halbich | |
| 4,807,744 | A * | 2/1989 | Chiou | A45C 11/24 206/214 |
| 4,936,462 | A | 6/1990 | Yuen | |
| 5,379,899 | A | 1/1995 | Thurell | |
| 5,806,670 | A | 9/1998 | Harlan et al. | |
| 6,454,097 | B1 * | 9/2002 | Blanco | A45C 3/02 206/459.5 |
| 7,337,899 | B2 | 3/2008 | Sterns | |
| 7,387,207 | B2 | 6/2008 | Priebe et al. | |
| 7,494,012 | B1 | 2/2009 | Priebe et al. | |
| 7,624,890 | B2 | 12/2009 | Noble et al. | |
| 7,798,330 | B2 | 9/2010 | Noble et al. | |
| 8,322,528 | B2 | 12/2012 | Sterns | |

(Continued)

*Primary Examiner* — Rafael A Ortiz

(74) *Attorney, Agent, or Firm* — AP Patents

(57) ABSTRACT

A storage and dispensing container comprises a housing including a bottom end and a peripheral wall upstanding on the bottom end and having an opening, the bottom end and the peripheral wall defining, in a combination with each other, a generally open top end and a hollow interior of the housing; one or more compartments defined within the hollow interior and having a bottom wall thereof spaced apart from an interior surface of the bottom end; a tray member movable between a retracted position and an extended position; and a writing implement holder being sized and shaped to receive a writing implement therewithin.

21 Claims, 15 Drawing Sheets

(56) References Cited

U.S. PATENT DOCUMENTS

| | | | | |
|---|---|---|---|---|
| 8,459,459 | B2 | 6/2013 | Noble et al. | |
| 8,550,251 | B1 * | 10/2013 | Ford | A61K 38/28 206/370 |
| D696,009 | S | 12/2013 | Priebe et al. | |
| D709,282 | S | 7/2014 | Priebe et al. | |
| 9,427,377 | B1 * | 8/2016 | Miceli | A61J 7/04 |
| 2008/0190951 | A1 * | 8/2008 | Gallagher | B65D 21/0233 220/826 |
| 2008/0230433 | A1 * | 9/2008 | Mulaw | A45C 11/00 206/534 |
| 2010/0032393 | A1 * | 2/2010 | Nikols | G09F 3/08 211/85.4 |
| 2012/0160730 | A1 | 6/2012 | Andrews et al. | |
| 2014/0262884 | A1 * | 9/2014 | Priebe | A61J 1/03 206/365 |

* cited by examiner

MULTI-COMPARTMENT MEDICINE STORAGE AND DISPENSING CONTAINER

CROSS-REFERENCE TO RELATED APPLICATIONS

This application is related to and claims priority from U.S. Provisional Patent Application Ser. No. 62/157,632 filed on May 6, 2015, the entire contents of which are hereby incorporated by reference thereto.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

1. Technical Field

The subject matter relates to medicine storage and dispensing. It further relates to a multi-compartment medicine storage and dispensing container.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

One of the recommendations to reduce medication errors and harm may be to use the "five rights of medicine administration": the right patient, the right drug, the right dose, the right route, and the right time. However, the five rights should be accepted as a goal of the medication process not the "be all and end all" of medication safety. It is important to follow the rules of the 5 rights of patient medication administration to keep the patient safe and prevent harm. Medical professional errors often occur in the medical field, and utilizing the five rights points can help to avoid these errors.

It may be important for every medical professional to be knowledgeable about the medication being given to the patient. It is not possible for every medical professional to know the drug facts on every drug. To be safe and competent, the medical professional should look up unfamiliar drug information before giving the medication to the patient. The patient has the right to information on the medication, the right to receive the correct medication, and the right to have a medical professional knowledgeable in the medication they are providing. Examples of the five rights of medicine administration may include:

Right Patient—Be sure you have the right patient before administering medication; Ask the patient to state their full name.

Right Medication—Check the bottle's label against the physician's authorization; Be sure they match.

Right Dose—Double check the amount of medication before administering; Be sure the amount to be given is clearly understood.

Right Time—Medication is to be given in substantial compliance with the physician's request; Within one half hour before or after the scheduled time.

Right Route—Designated medical professionals are authorized to administer oral medication only; Do not administer ear, eye, nose drops, topical medication, or injected medication.

Typically, medicine may include a special food or a chemical that makes someone better when they are ill. A lot of medicines are liquid and can be bought in a small bottle. Other medicines may come in pills or capsules. The doctor may tell the patient or caregiver how much medicine to take each day. Most medicines cannot be bought unless a doctor (or other authorized professional) has prescribed the medicine for the patient. Often, the doctor or pharmacist provide specific instructions for administering the medicine, including dosages, quantities, and warnings.

Typically, multi-compartment medicine containers are containers that contain medicine prescribed by doctors. Medicine containers come in different shapes, sizes, and colors. The most common is an orange pill bottle, opaque liquid bottle or a pill box.

Typically, consumption by way of dosage forms may be a mixture of active drug components and nondrug components. Depending on the method of administration they come in several types. These are liquid dosage form, solid dosage form and semisolid dosage forms. Various dosage forms may exist for a single particular drug, since different medical conditions can warrant different routes of administration. Additionally, a specific dosage form may be a requirement for certain kinds of drugs, as there may be issues with various factors like chemical stability or pharmacokinetics. The oral and intravenous doses of a medicine may also vary depending on the patient, the strength of the medication, and the severity of the illness.

However, it may be difficult to track medicine information and/or consumption with multi-compartment medicine container.

BRIEF DESCRIPTION OF THE DRAWINGS

The accompanying drawings are incorporated in and constitute part of the specification and illustrate various embodiments. In the drawings.

DETAILED DESCRIPTION OF EXEMPLARY EMBODIMENTS

Figure 1:
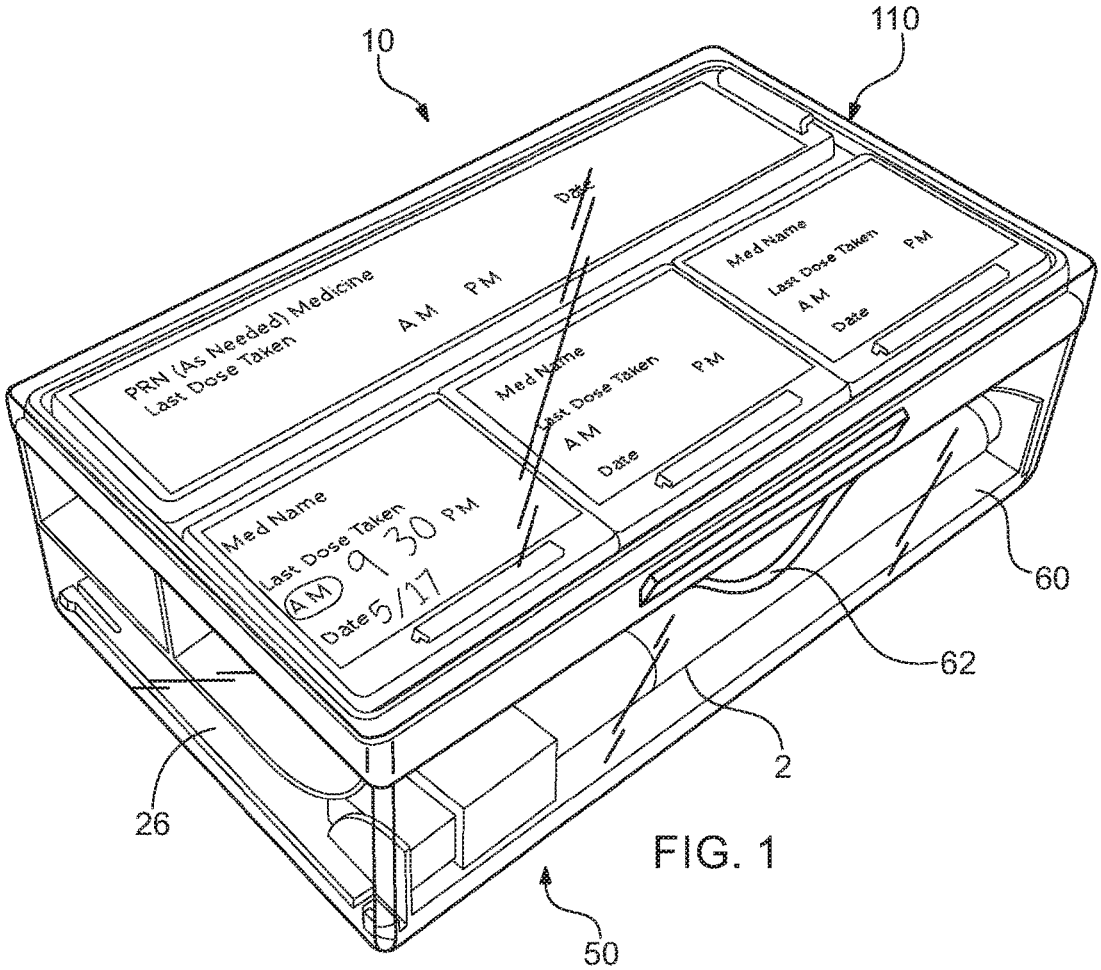
FIG. 1 illustrates a front 3-D view of a multi-compartment storage and dispensing container in accordance with an exemplary embodiment.
Figure 2:
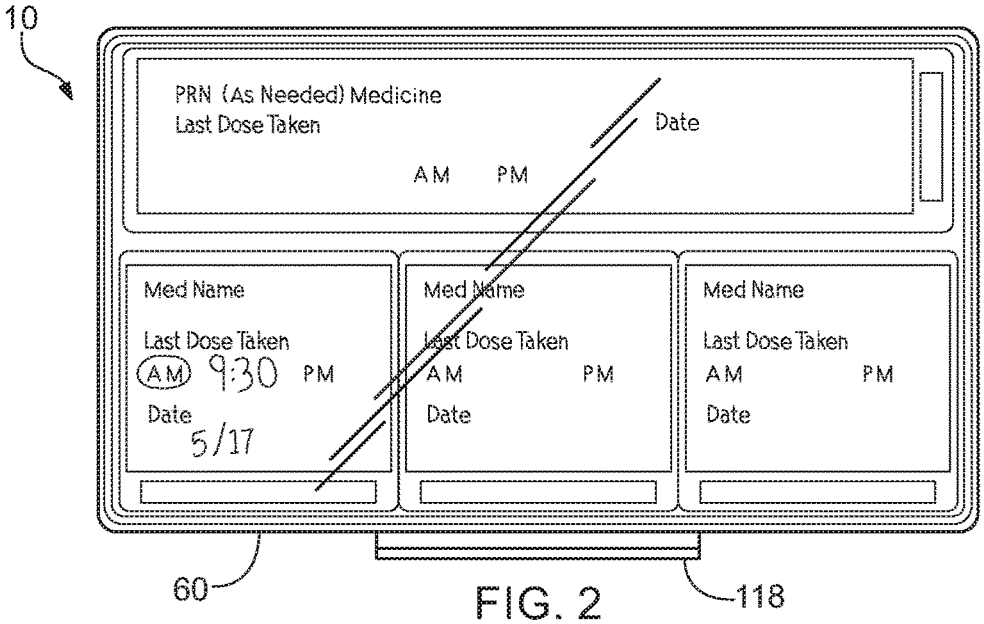
FIG. 2 illustrates a top planar view of the container of FIG. 1.
Figure 3:
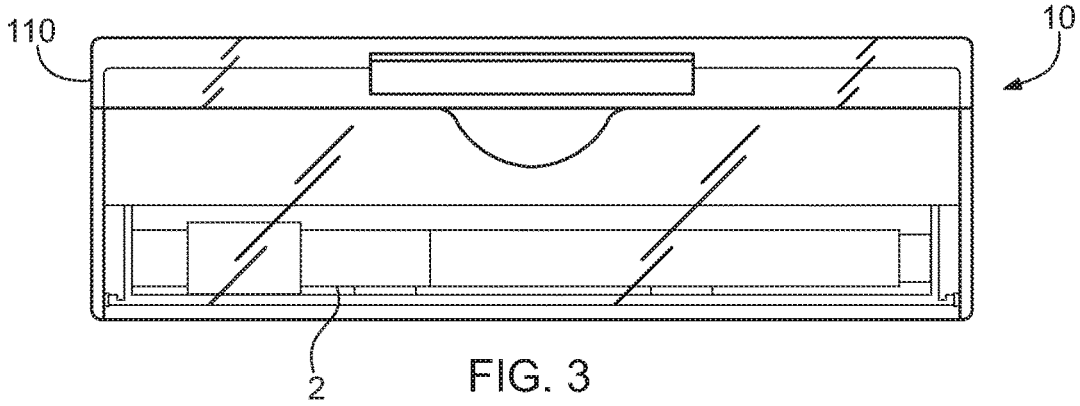
FIG. 3 illustrates a side elevation view of the container of FIG. 1.
Figure 4:
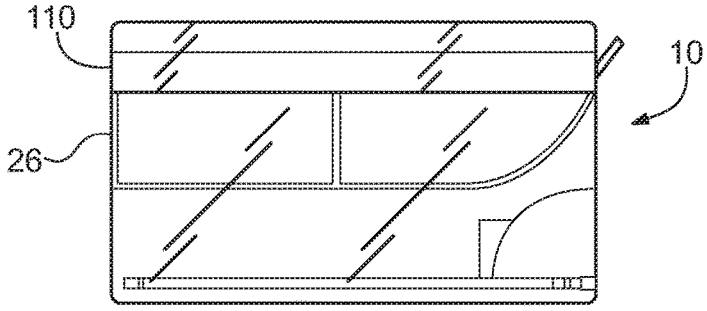
FIG. 4 illustrates a front elevation view of the container of FIG. 1.
Figure 5:
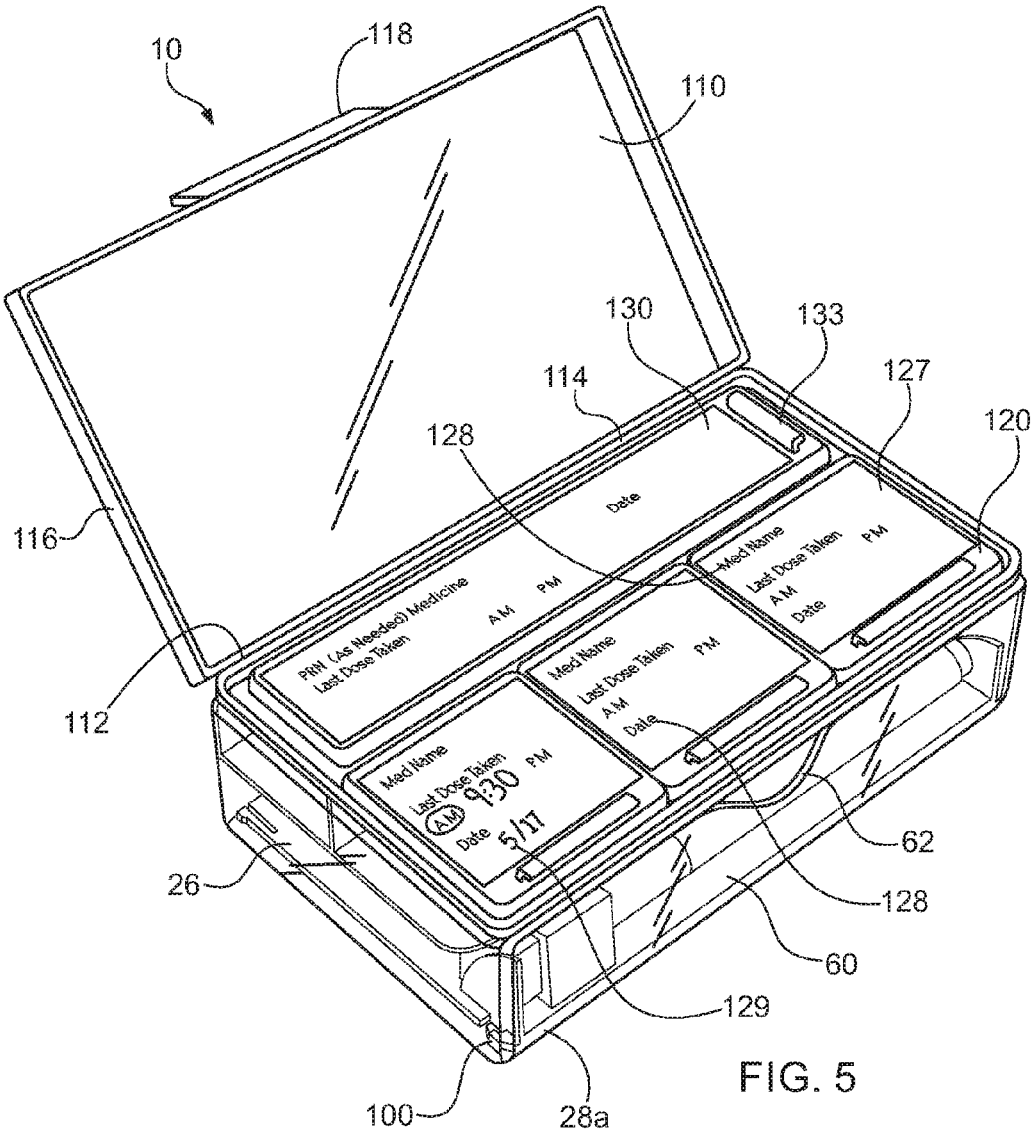
FIG. 5 illustrates a 3-D view of the container of FIG. 1, particularly illustrating a lid in an open position.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As may be used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

References in the specification to "one embodiment", "an embodiment", "an exemplary embodiment", "another embodiment", "a presently preferred embodiment", "an alternative embodiment", "one variation", "a variation" and similar phrases mean that a particular feature, structure, or characteristic described in connection with the embodiment or variation, is included in at least an embodiment or variation of the invention. The phrase "in an embodiment", "in one variation" or similar phrases, as may be used in various places in the specification, are not necessarily meant to refer to the same embodiment or the same variation.

For purposes of description herein, the directional and/or relationary terms such as "upper", "top", "lower", "bottom", "left", "right", "rear", "back", "front", "apex", "vertical", "horizontal", "lateral", "exterior", "interior" and derivatives thereof are relative to each other and are dependent on the specific orientation of an applicable element or article, and are used accordingly to aid in the description of the various embodiments and are not necessarily intended to be construed as limiting. It will be understood that the spatially relative terms are intended to encompass different orientations of the device in use or operation in addition to the orientation de depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The term "or" when used in this specification and the appended claims is not meant to be exclusive; rather the term is inclusive, meaning either or both.

The term "couple" or "coupled" when used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The terms "removable", "removably coupled", "removably disposed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

As may be used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

Anywhere the term "comprising" is used, embodiments and components "consisting essentially of" and "consisting of" are expressly disclosed and described herein."

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The particular embodiments of the present disclosure generally provide devices and methods directed to storage, consumption and/or dispensing of various contents.

The particular embodiments, a device or article of manufacture, for managing consumption and/or dispensing of contents includes a housing with compartments configured for housing contents, lid on each compartment with a write-on surface and a sliding tray member configured to releasably secure a writing implement. The write-on surface at least partially configured, sized and/or shaped to receive indicia thereon without binding and/or being absorbed thereby.

In particular embodiments, the device or article of manufacture is a multi-compartment medicine holding container for managing prescription and non-prescription medicine consumption.

When concerned with medicine consumption and/or dispensing, the medicine may be any one of pills, tablets, capsules, liquids, patches, creams, ointments, eyedrops, eardrops, buccals, dissolving medicine, effervescents, aerosols, suspensions, emulsions, topicals, chewables, sublinguals, reconstitutables and injectables type related to prescriptions, over-the-counter medications, vitamins and/or supplements, and the like.

Now in a reference to FIGS. 1-9, a storage and dispensing container, generally designated as 10, comprises a housing 20 including a bottom end 22, which is preferably a closed end, and a peripheral wall 26 upstanding on the bottom end 22 and having an opening 28. The bottom end 22 and the peripheral wall 26 defining, in a combination with each other, a generally open top end 30 and a hollow interior 32 of the housing 20. The peripheral wall 26 and the bottom end 22 may be configured to define a rectangular or a square shape of the housing 20. The bottom end 22 can comprise a member with a generally flat surfaces, spaced apart from each other to define a thickness of the bottom end 22. One of these surfaces, referenced with numeral 24, defines an interior surface of the housing 20. The opening 28 is provided in a portion of the peripheral wall 26 adjacent to the bottom end 22. The bottom edge 28*a* of the opening 28 may be disposed flush with the interior surface 24 of the bottom end 22 or may be disposed upwardly at a distance therefrom. The opening 28 may extend an entire height of the peripheral wall 26 or may be shorter than such entire height to define a wall portion 34. The opening 28 and the wall portion 34 may define a front end of the housing 20.

The container 10 comprises one or more compartments 40 defined within the hollow interior 30. One or more compartments 40 have a bottom wall 42 thereof disposed at a distance from the interior surface 24 of the bottom end 22 toward the open top 30. The one or more compartments 40 may have a common bottom wall 42. Each of the one or more compartments 40 may have a different bottom wall. The space between the bottom end 22 and the bottom wall 42 defines a hollow portion or space 33 of the hollow interior 32. In other words, the bottom wall 42 is positioned mediate the bottom end 22 and the top end 30. The front end of the bottom wall 42 may be curved to join with the wall portion 34. Two adjacent compartments 40 are separated from each other by a partition 44.

The container 10 can comprise a tray member 50, best illustrated in FIGS. 6-9. The tray member 50 has a first portion 52 thereof positionable within a hollow portion 33 between the bottom wall 42 of the one or more compartments 40 and the bottom end 22 of the housing 20. The tray member 50 also has a second portion 60 thereof upstanding on a front edge 54 of the first portion 52. The tray member 50 is adapted to move linearly and reciprocally between a retracted, or first, position, where the first portion 52 is being essentially fully disposed within the hollow portion or space 33, and an extended, or second, position, where the first portion 52 is being essentially extended from the hollow portion 33 with the second portion being disposed or spaced at a distance from the wall portion 34. In the first position, the second portion 60 covers the opening 28 in the peripheral wall 26. In the first position, the second portion 60 may be disposed within the opening 28, essentially becoming a portion of the peripheral wall 26, may protrude slightly outwardly from the opening 28 and abut the front surface of the rail 34 or may be inset inwardly into the hollow portion or space 33. The second portion 60 does not have to fully cover the opening 28. When the second portion 60 is disposed within the opening 28 or inset inwardly therefrom, a rear edge 58 of the first portion 52 can be configured to abut an inner surface of the peripheral wall 26. In other words, the second portion 60 does not have to seal the opening 28, when the tray member 50 is in the retracted or first position. The second portion 60 is configured to be pulled and pushed by the user of the container 10. Any type of finger pulls is contemplated herewithin. By way of one example only, such finger pull may be an edge cavity 62 in the second portion 60. The cavity 62 may be also disposed at a bottom of the second portion 62. The finger pull may be also a tab on the exterior surface of the second portion 60.

The tray member 50 is configured with a writing implement holder to releasably secure a writing implement 2. In an example only, the writing implement holder may comprise end tabs or members 70 and 72 and a lateral tab or member 74 that are provided on interior surfaces of the first and second portions, 52 and 60 respectively, of the tray member 50 and define an open compartment 76 sized and shaped to receive a writing implement 2 therewithin. The writing implement 2 does not have to be caged within the compartment 76 and some movement of the writing implement 2 is contemplated herewithin. In an example, conventional c-shaped retaining clips (not shown) being attached to the inner surface of the first portion 52 or the inner surface of the second portion 60 are also contemplated herewithin. Such clips may be of a type as disclosed in U.S. D696,009 S issued on Dec. 24, 2013 to Apothecary Products, Inc. and whose disclosure is incorporated in its entirety by reference herewithin.

An optional write-on surface 80 may be provided on an interior surface 56 of the first portion 52. The write-on surface 80 is of the type enabling repetitive erasing and writing thereon.

The write-on surface 80 on the interior surface 56 of the first portion 52 may be provided as a removable member 82, for example such as a card, releasably held in a working position on the interior surface 56 of the first portion 52 by a pair of tabs 84 provided at the rear edge 58 of the first portion 52. The write-on surface 80 may be also rigidly coupled to the inner surface 56, for example by way of an adhesive (not shown). The write-on surface 80 may comprise a pre-printed indicia 82 and area(s) for the user to manually adhere indicia 84 with the writing implement 2. The pre-printed indicia 82 may be configured to identify content related information that the user write-on as indicia 84. For example, when the container 10 is used to store and dispense medicine, indicia 82 and indicia 84 may be configured, in a combination with each other, to define the name and/or type of the medicine, dosage, specific instructions and the like information.

The pre-printed indicia 82 may, for example, include medicine name, use, medicine description, dosage, special instructions/precautions.

The write-on surface 80 can be configured and/or provided as a removable card (for example being about business card size). When the write-on surface 80 is configured and/or provided as a removable card, the first portion 52 can be adapted with one or more edge tabs 86 configured to detachably or releasably secure the removable card in a working position on the surface of the first portion 52 during use of the container 10. The cards can slide in and out from one side of the first portion 52. When the write-on surface 80 is configured and/or provided as a removable card, the container 10 may be adapted with a pouch or sleeve (not shown) open on one side and coupled to the tray member 50 for example with a glue or adhesive. The card can than slide in and out of the pouch or sleeve. The pouch or sleeve can be provided instead of the edge tabs 86. The pouch or sleeve can be provided in a combination with the edge tabs 86 so that the edge tabs 86 detachably secure the pouch or sleeve on the first portion 52 of the tray member 50. When the write-on surface 80 is configured and/or provided as a removable card, such card can be provided with a self-adhesive bottom portion configured for a repetitive removal and re-adherence of the card. When the write-on surface 80 is configured and/or provided as the removable card with the self-adhesive bottom portion, the edge tabs 86 may not be required, although they can be provided if a different write-on surface 80 without the adhesive bottom portion is to be used. The write-on surface 80 can be configured and/or provided as a removable multi-page pamphlet or a multi-page booklet detachably secured or held on the first portion 52 by way of one or more edge tabs 86. The write-on surface 80 can be configured and/or provided as a peelable label.

When the container 10 is used to store and dispense medicine, the user of the container 10 can write/transfer their medicine information to these cards (with pen, pencil, or marker). This information should pertain to the medications in the container 10. Prescription labels may also be used. The purpose is to help people refer to medication instructions and medication description to assist with taking medications correctly.

It is also contemplated that the write-on surface 80 may be provided only with the preprinted indicia 82 also comprising the contents of the indicia 84 or may be provided as a blank surface for the user to adhere the indicia 82 and/or 84 with the writing implement 2.

In order to adhere the indicia 84, the user would generally extend or move the tray member 50 outwardly into the second position enough to gain access to the writing implement 2 and to required area on the writing surface 80. The user then removes the writing implement 2 from the compartment 76 and proceeds to adhere the indicia 84 as applicable, for example based on type of the contents within the container 10. The user may even completely remove the tray member 50 from the hollow portion 33. In other words, the user may separate the tray member 50 from the housing 20 of the container 10. When the user completed adhering the indicia 84, the user replaces the writing implement 2 into the compartment 76 and generally returns the tray member 50 to the first position, although the user may leave the tray member 50 in the second position.

It is contemplated that the user may have to erase previously adhered indicia 84 and adhere new indicia 84 therefore, the write-on surface 80 can be thus configured for repetitive erasing and adhering of the indicia 84.

Medicine container or boxes, by definition, typically contain one or more different medications. Many pills are provided in white color and are also provided in similar shapes and size. Drug confusion is common for at least several reasons. Physicians often change drug strength for the purpose of regulating a condition. One pill may appear to have the same size, shape and color as another. In reality, it could be a totally different pill for a totally different purpose/condition. A big misconception among patients is that the same sizes of two pills may identify equal medication strength, but in reality, one pill can have a different strength than another pill.

In today's busy society, people tasked with taking or aiding in taking medicine often multi-task and can be easily distracted, particularly when taking or aiding in taking medicine. The tray member 50 with the write-on surface 80 can reduce errors in taking or aiding in taking medicine and can further reduce associated Emergency Room and physician-related visits by encouraging and teaching users of the container 10 practice diligences in identifying and administering medicine. It can prevent, either partially or completely inadvertent medication mis-identification and subsequent overdosage or underdosage. The user of the container 10 can adhere the necessary/applicable indicia 84 on the write-on surface 80 to be configured as a reminder during storing and/or dispensing medication.

One advantage of the sliding tray member 50 is in that such tray member 50 can encourage ease of medication identification to at least prevent if not completely eliminate errors in medication consumption. Pharmacies can often change generic medication manufacturers due to competitive pricing. The same medication that a patient may have grown accustomed to can often change in size, shape and/or markings from one refill to the next, depending solely on the selected medication manufacturer at the time of the refill.

One advantage of the sliding tray member 50 is in that such tray member 50 can reduce patient confusion be keeping the medication and its information in one area. The combination of recording usage, for example such as last dose of medication taken, and medication identification (including patient/medication name, dosage, directions and/or warnings) can provide a medication adherence tool designed to help patients and/or their caregivers improve their understanding about the medication and further improve consumption of such medication.

One advantage of the sliding tray member 50 is in that such tray member 50 can help patient function independently, reduce hospital admissions or re-admissions and/or delay use of long term care facilities.

Figure 9:
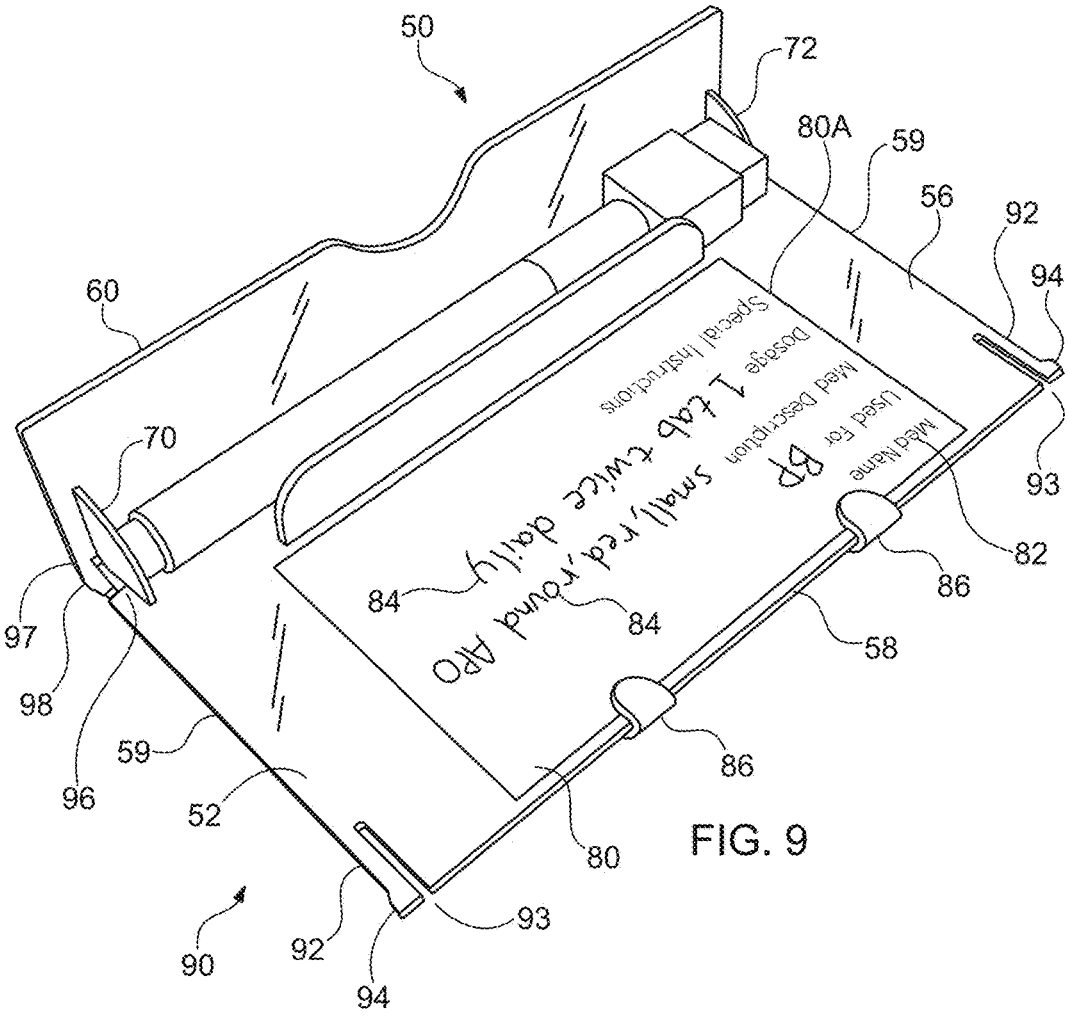
FIG. 9 illustrates a 3-D view of the tray employed within the container of FIG. 1.
Figure 10:
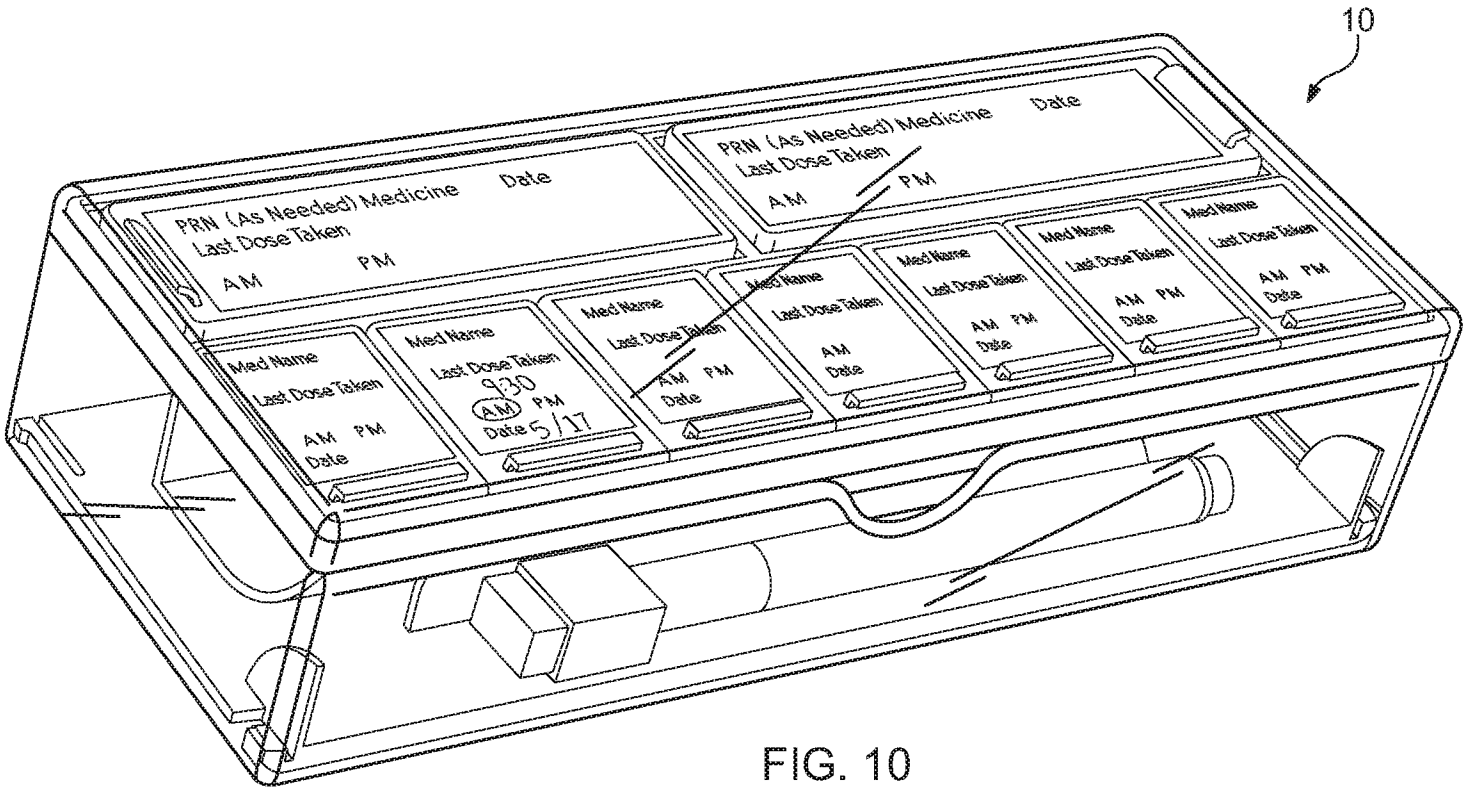
FIG. 10 illustrates a front 3-D view of a multi-compartment storage and dispensing container constructed in accordance with an exemplary embodiment.
Figure 11:
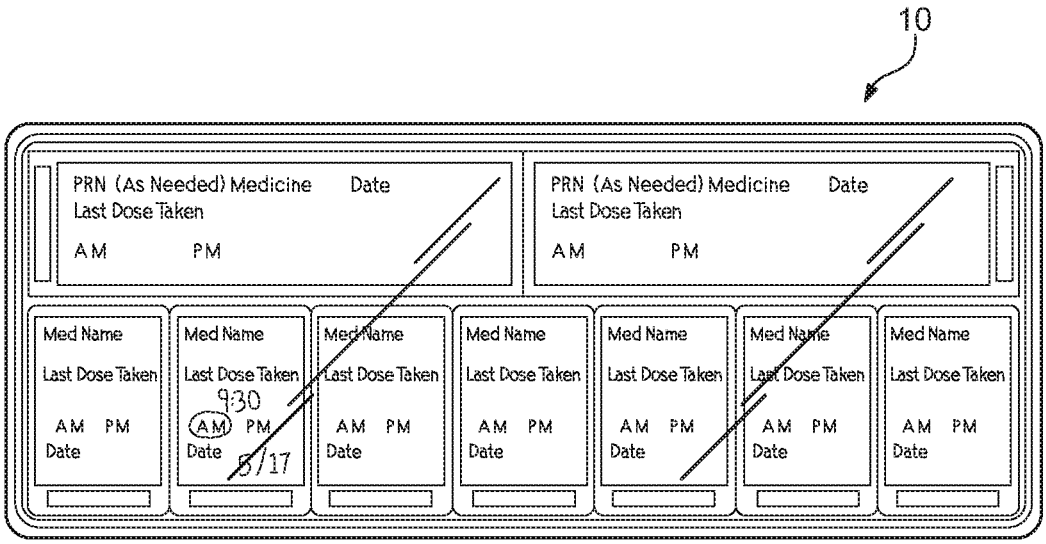
FIG. 11 illustrates a top planar view of the container of FIG. 10.
Figure 12:
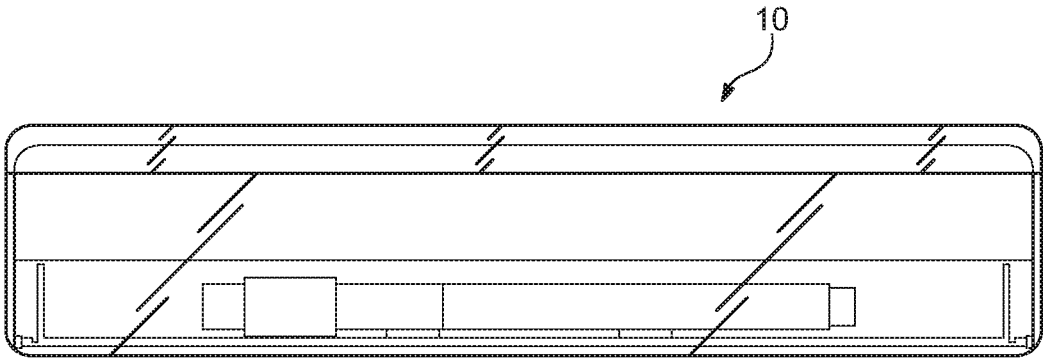
FIG. 12 illustrates a front elevation view of the container of FIG. 10.
Figure 13:
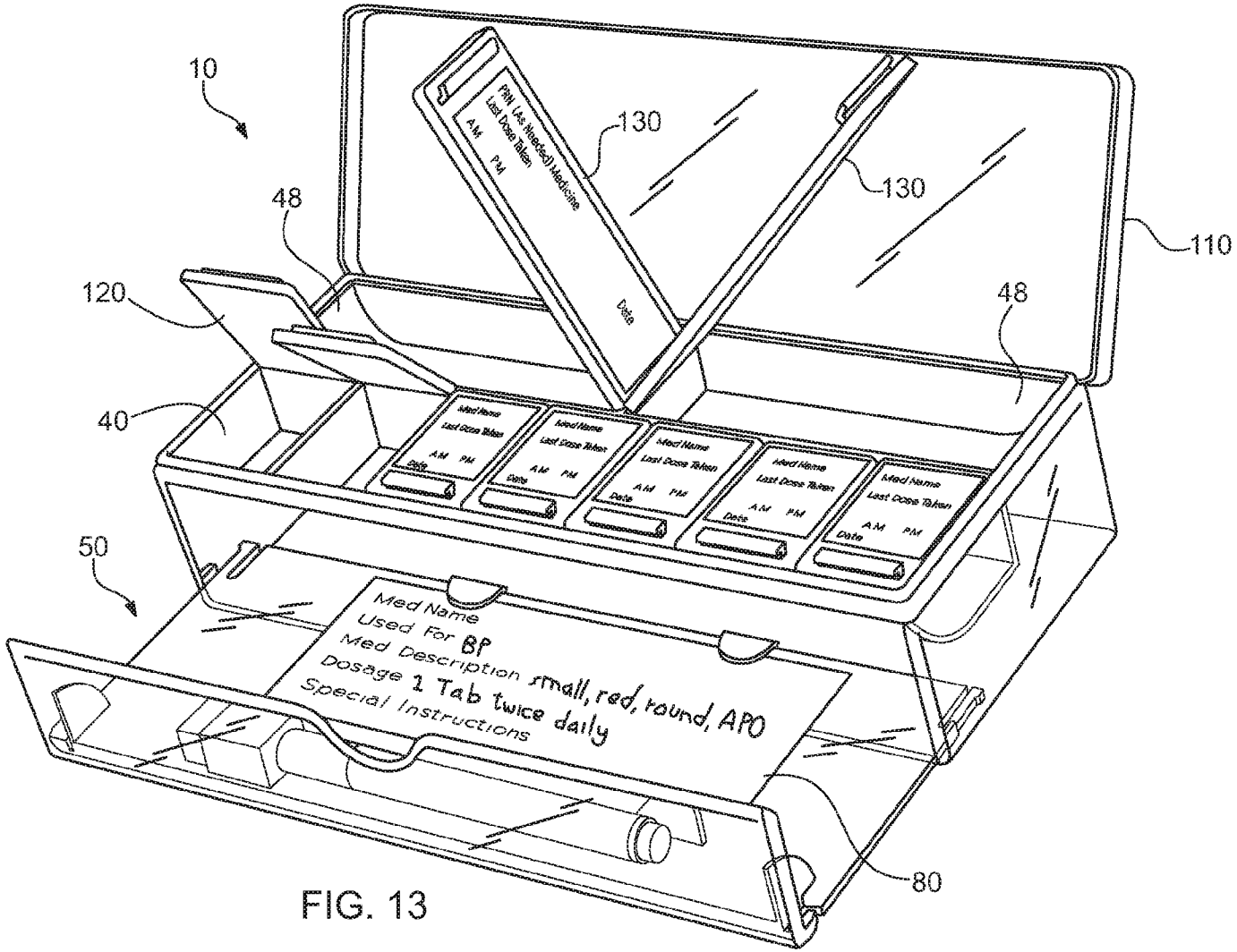
FIG. 13 illustrates a 3-D view of the container of FIG. 10, particularly illustrating container lid, compartment covers in open position and a tray in an extended position.
Figure 14:
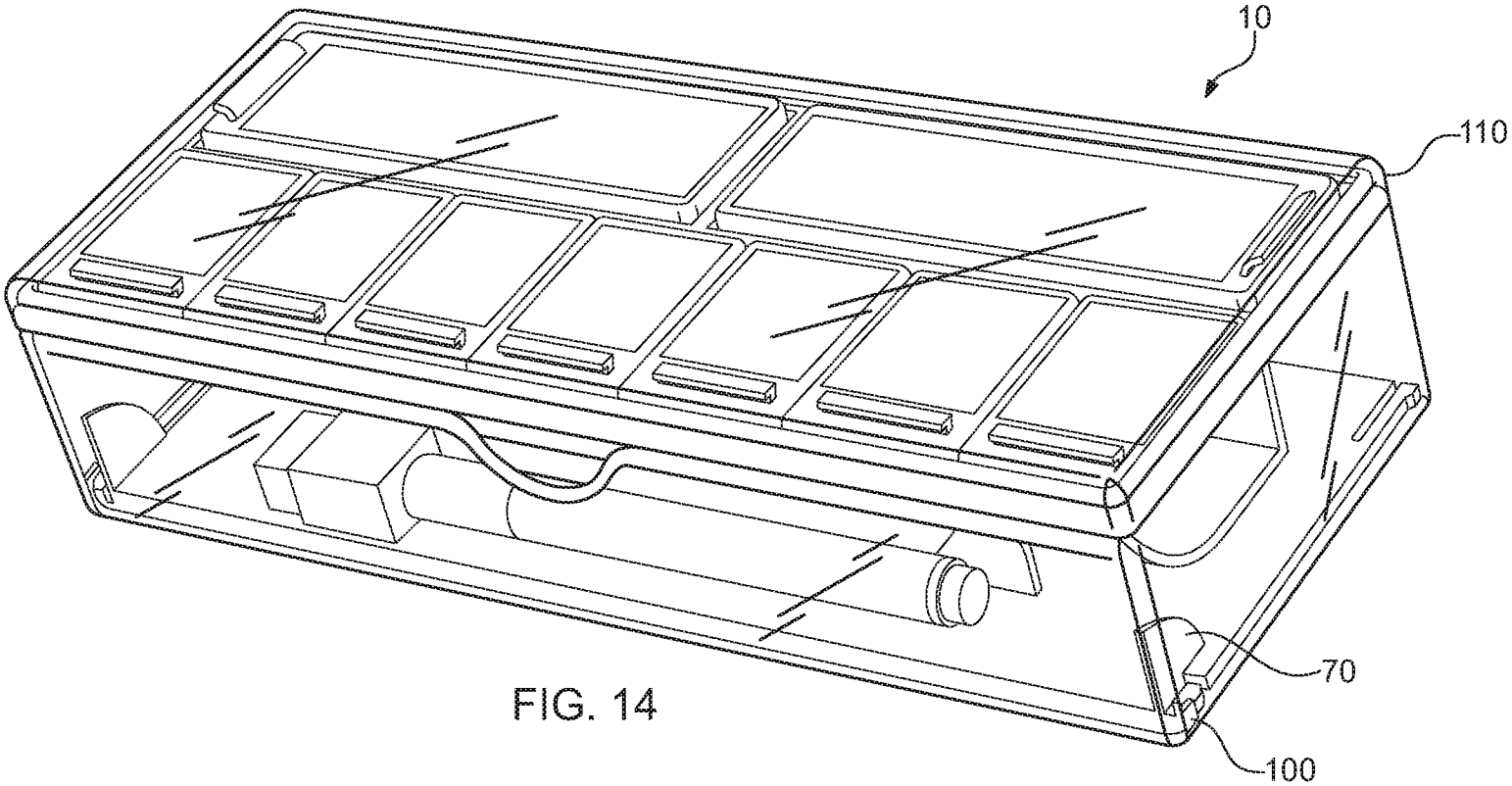
FIG. 14 illustrates another top planar view of the container of FIG. 10.

The tray member 50 may be configured to at least restrict if not completely prevent unintentional removal thereof during use from the hollow portion or space 33. FIG. 9 best illustrates an example of how the tray member 50 can be configured for the above purpose. In an example of FIG. 9, two first notches 90 are formed through a thickness of the first portion 52 where an outer end of each notch 90 is in an open communication with a rear edge 58 thereof. Each first notch 90 is further positioned adjacent a respective side edge 59 of the first portion 52 but a distance therefrom to define an arm 92 that is sufficiently flexible to pivot at its juncture with an inner end of the first notch 90. A first tab 94 is provided on each arm 92, planar with the first portion 52, and extends outwardly from each side edge 59 of the first portion 52 adjacent the rear edge 58 thereof. The first tab 94 may be disposed flush with the rear edge 58 or may be disposed inwardly therefrom. Two L-shaped second notches 96 are also formed through the thickness of the first portion 52 adjacent the front edge 54 thereof to define an arm 97 that is sufficiently flexible to pivot at its juncture with the second portion 60. A second tab 98 is disposed on the arm 97, planar with the first portion 52, and extends outwardly from the side edges 59 of the first portion 52 adjacent but spaced from the front edge 54 thereof. The notches 90, 96 and the tabs 94, 98 can be so sized that arms 92, 97 pivot or collapse inwardly to achieve a tension onto the inner surface of the peripheral wall 26 during movement of the tray member 50 between first and second positions and when the tray member 50 is stored in the second position. Furthermore, such tension is sufficient to prevent unintended movement of the tray member 50 even when the container oriented such that the second portion 60 of the tray member 50 is a bottom portion of the container 10.

Figure 6:
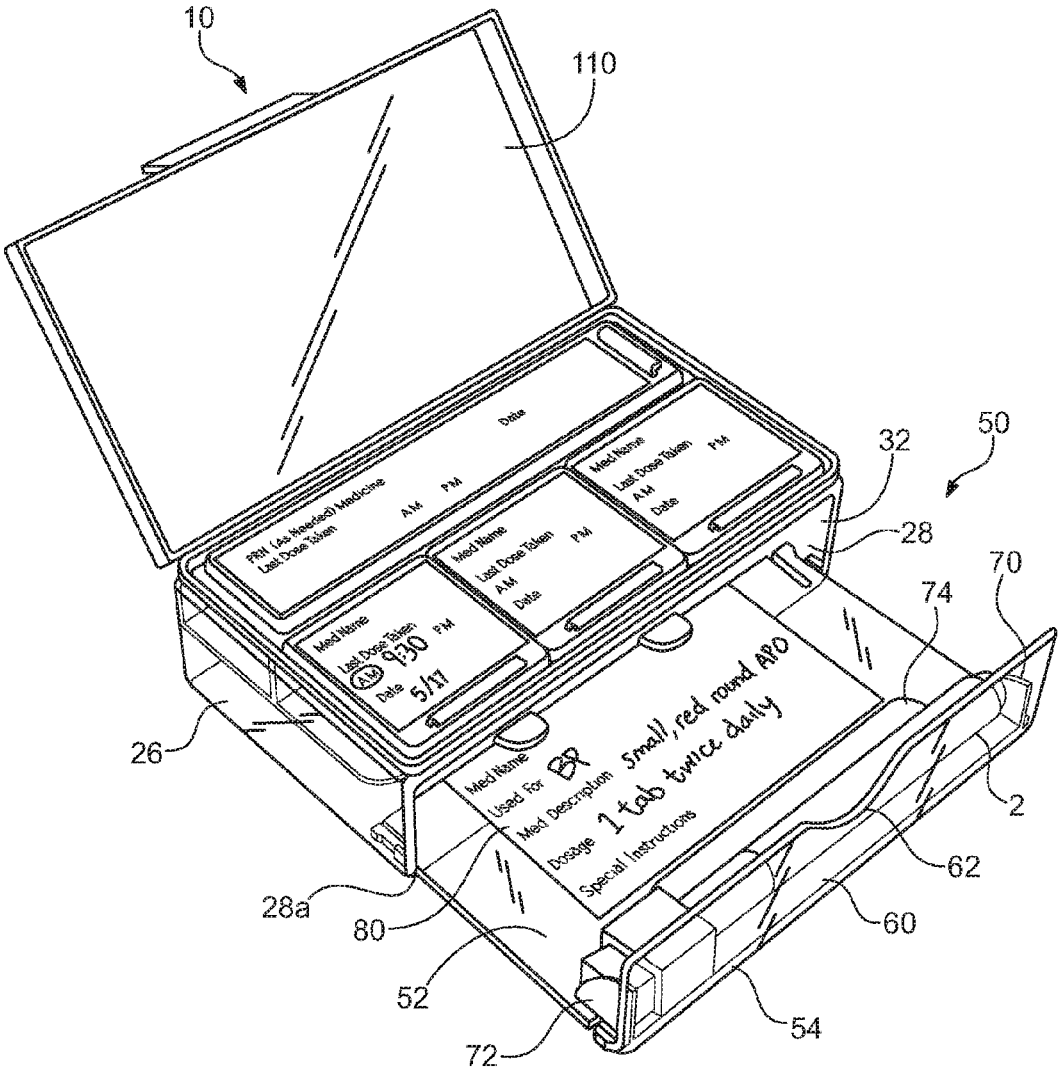
FIG. 6 illustrates a 3-D view of the container of FIG. 1, particularly illustrating a lid in an open position and a tray in an extended position.
Figure 7:
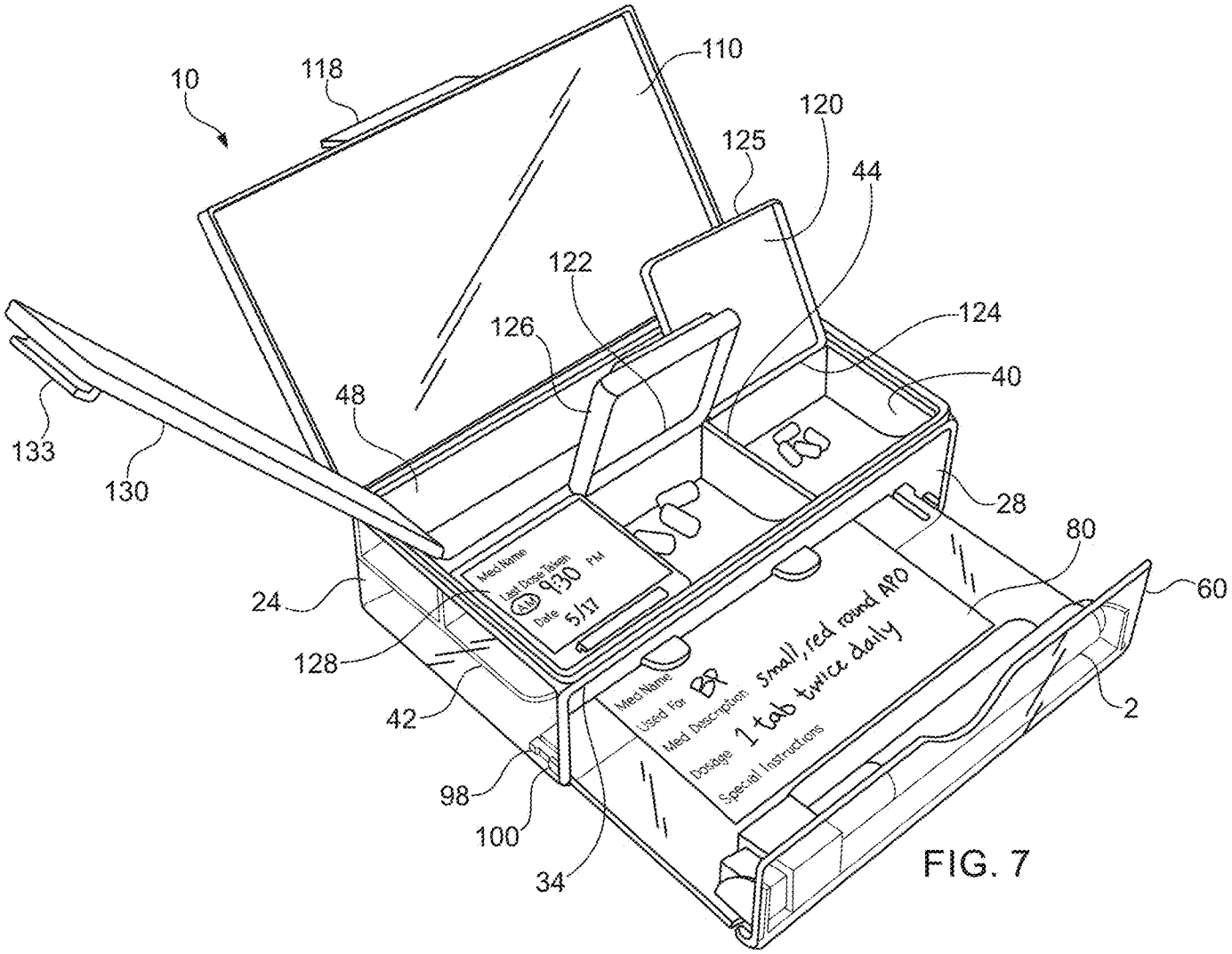
FIG. 7 illustrates a 3-D view of the container of FIG. 1, particularly illustrating a lid in an open position, a tray in an extended position and individual compartment covers in an open position.
Figure 8:
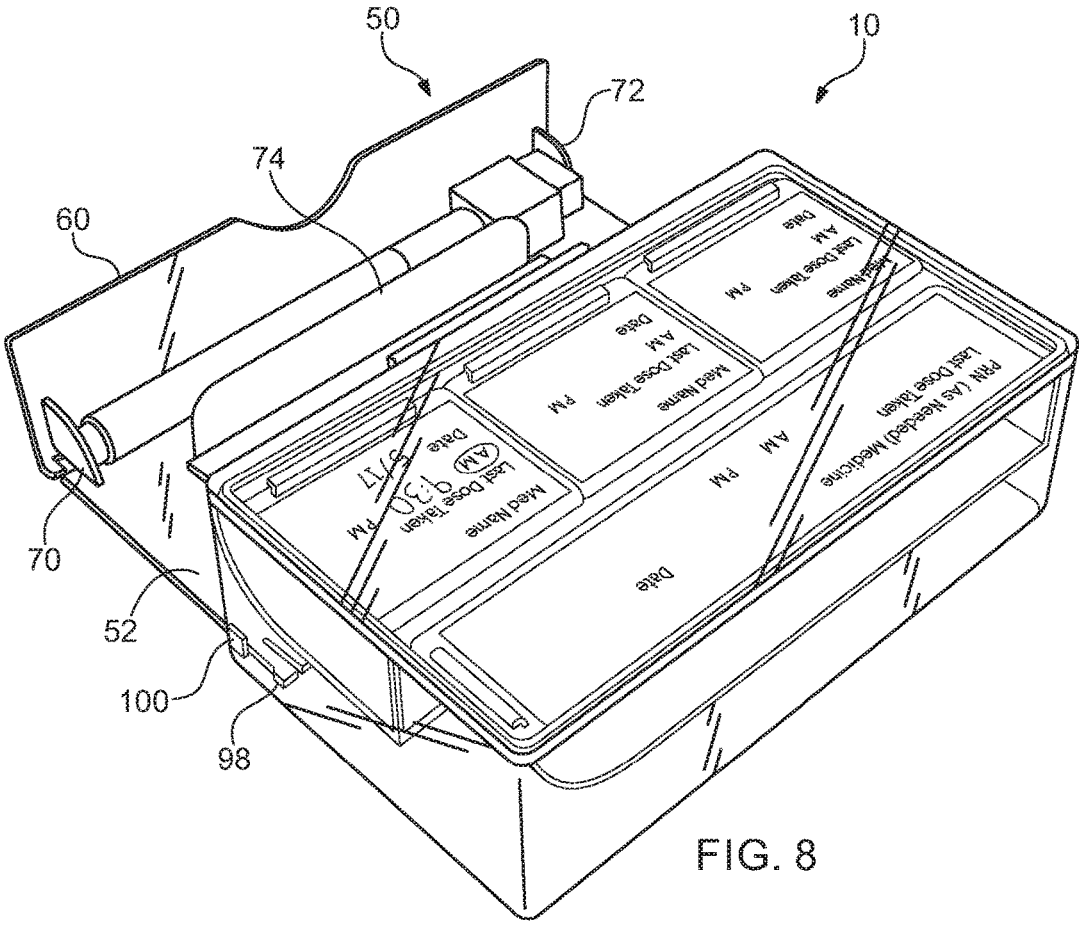
FIG. 8 illustrates a rear 3-D view of the container of FIG. 1, particularly illustrating a tray in an extended position.

Now in a further reference to FIGS. 6-8, the container 50 may be adapted with two optional third tabs 100 provided on inner surfaces of the peripheral wall 26 adjacent the opening 28. Each third tabs 100 is positioned between a respective second tab 98 and the opening 28 when the tray member 50 is in the second position. The third tabs 100 can be provided on the interior surface of the peripheral wall 26 or on the inner surface 24 of the bottom end 22.

In other words, the third tabs 100 are provided or disposed in an operative alignment with first and second tabs, 94 and 98 respectively, so that the first and second tabs, 94 and 98 respectively, move, upon application of a manual force, inwardly into the hollow portion 33 to allow at least a partial insertion or a partial removal of the first portion 52 from the hollow portion or space 33. The notches 90 and 96 allow inward movement of the tabs 92 and 98 so as to clear the third tabs 100 during insertion or removal movement.

Notches 90, 96 and tabs 94, 98 may provide means for preventing an unintentional removal of the first portion 52 of the tray member 50 from the hollow interior 32.

In order to prevent full removal of the tray member 50, the tray member 50 is moved outwardly from the housing 20 until the first tabs 94 come in contact with the third tabs 100, at which point the further movement of the tray member 50 is terminated without application of a greater pull force, and the write-on surface 80 and the writing implement 2 are available for use by the user of the container 10. When optional third tabs 100 are provided, the tabs 94, 98 do not have to be in a tension with the inner surface of the peripheral wall 26 and can simply abut the inner surface of the peripheral wall 26 without change in the width of the respective notches 90 and 96, or spaced a small distance therefrom, even allowing some lateral (normal to the above described movement of the tray member 50) movement of the first portion 52 within the hollow portion 33.

In an embodiment, the storage and dispensing container 10 may further comprise an optional lid or cover 110 to selectively cover and uncover the open top end 30 and essentially cover and uncover all compartments 40.

In an example, the lid or cover 110 may be provided independently from the housing 20 and be adapted with flanges 116 that frictionally engage exterior surface of the peripheral wall 26 when the lid or cover 110 covers the open end 30. The lid or cover 110 may be configured, with or without the flanges 116, to be disposed within the open end 30. In other words, the lid or cover 110 can be configured for a snap fit with the housing 20, in either external or internal manner. The lid or cover 110 may also have a finger tab or pull 118.

In an example, the lid or cover 110 can be provided integrally with the housing 20 by comprising a hinged connection 114 between one edge 112 of the lid or cover 110 and an edge portion of the peripheral wall 26 so that the lid or cover 100 selectively covers and uncovers the open top end 30 of the housing 20. The hinge connection may be a living hinge. The integral lid or cover 110 may be provided with the above described flanges 116 for external or internal snap-fit with the housing 20. The lid or cover 110 may also have a finger tab or pull 118.

In either example, the lid 110 may be manufactured from a clear or opaque material.

In an embodiment, each compartment 40 may be provided with its individual lid or cover 120. The lids or covers 120 can be provided independently from the housing 20 and configured for a snap fit with a respective compartment 40. The lids or covers 120 can be provided integrally with the housing 20, each with a hinged connection 124 between an edge 122 of each lid or cover 120 and an edge portion of each compartment 40 so that each lid or cover 120 selectively covers and uncovers an open end 44 of the respective compartment 40. In either example, the lid or cover 120 may be manufactured from a clear or opaque material. In either example, each lid or cover 120 may also be adapted with a finger tab or pull 125.

The storage and dispensing container 10 may further comprise a write-on surface 127 on an exterior surface 126 of each lid or cover 120. The write-on surface 127 may be provided in a similar arrangement to the above described write-on surface 80. In an example, the write-on surface 127 may comprise pre-printed indicia 128 and user-adhereable indicia 129.

When the container 10 is provided for storing and dispensing medicine, the write-on surface 127 can be of a dry-erase type. The dry erase areas on top of each compartment 40 can correspond with the medication inside the compartment 40. The curved area inside the front three compartments 40 facilitates easier pill or medicine retrieval. The pre-printed indicia 128 in this embodiment may include information, such as medicine name, Last Dose Taken or Next Dose to be Taken, time of the day (AM or PM) and date and is configured to provide a reminder to the information that needs to be updated immediately after taking a dose of medicine. The user erases the information written on top with the eraser, for example such as provided with the writing implement 2, if he will take another medicine. After, either immediately or after a short period of time, giving/taking a medicine, the user writes down the current time on the dry erase surface, including the date. This time now represents THE LAST DOSE TAKEN.

Also illustrated in FIGS. 1-9 is an optional secondary compartment 48, spanning a width of all three compartments 40 and is being separated therefrom with another partition 46.

In an embodiment, the optional secondary compartment 48 may be open. In an embodiment, the optional secondary compartment 48 may be selectively covered and uncovered by the above described lid or cover 110. In an embodiment, the optional secondary compartment 48 may be adapted with a cover 130 that could be provided either separately or integral with the housing 20, similar to the above described cover 120. In an embodiment, the cover 130 can be adapted with a write-on surface 132 and/or finger pull 133 that can be identical in shape to the above described pull 118 or 125. Although the length of each pull can be different from a length of remaining pulls.

When the container 10 is provided for storing and dispensing medicine, three compartments 40 can be used to store and dispense three different types of medicine, for example such as prescription drugs.

Although three compartments 40 are illustrated in FIGS. 1-9, more or less compartments 40 can be provided. For example, an embodiment of FIGS. 10-14 provides a container 10 with seven compartments 40. When the container 10 is provided for storing and dispensing medicine, seven compartments 40 can be used to store and dispense a week worth of medicine, with one compartment 40 being designated or used for each day of the week.

As is illustrated in embodiments of FIGS. 1-14, the compartments 40 are positioned in a single row, in series with each other along the wall portion 34 or along the opening 28. The compartments 40 may be also positioned in a grid pattern. For example, two or more rows of compartments 40 may be provided.

When the container 10 is provided for storing and dispensing medicine, secondary compartment(s) 48 can be used for what is conventionally known as "prn" medications to be taken on as needed basis.

Figure 15:
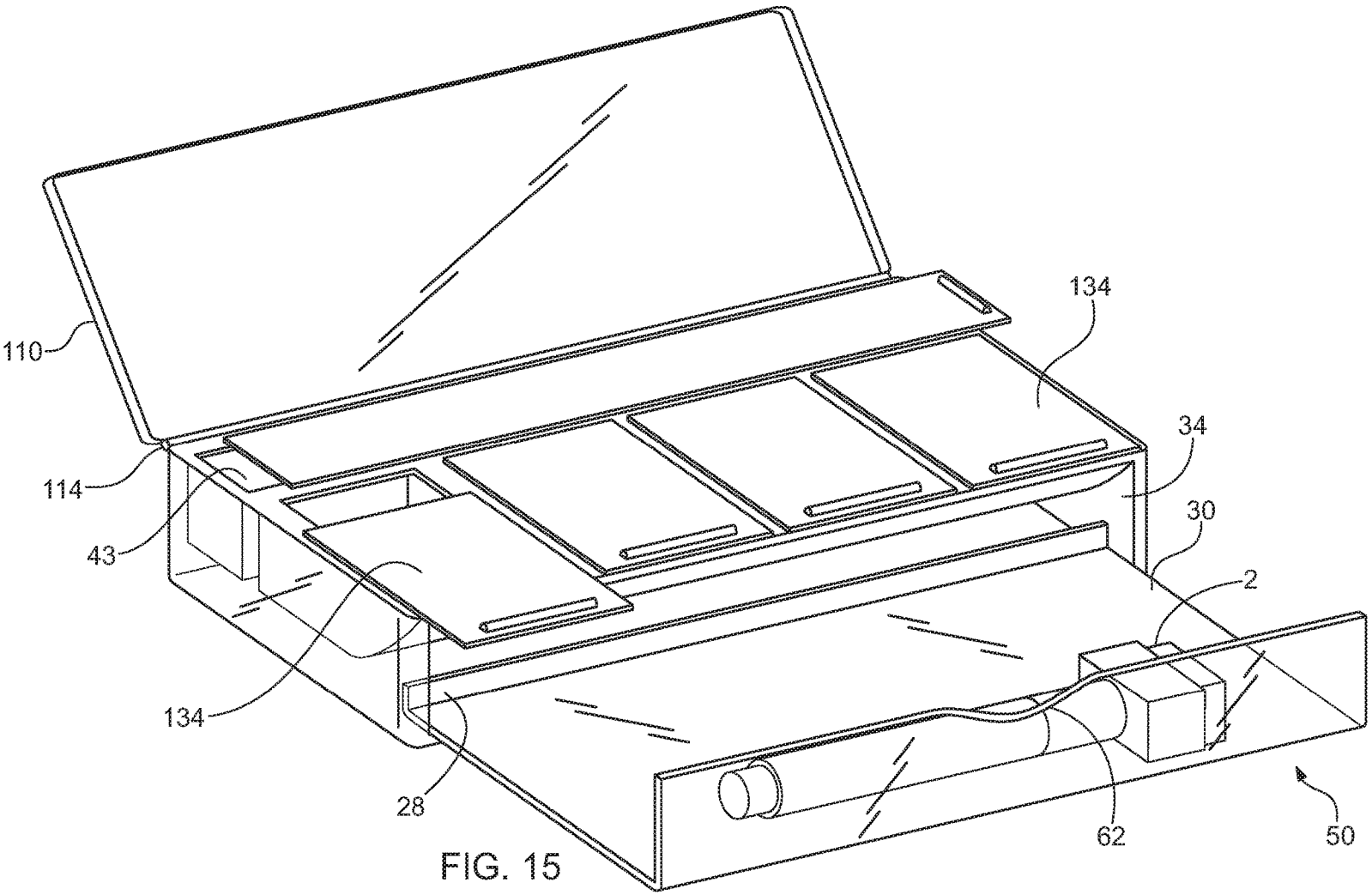
FIG. 15 illustrates a 3-D view of a multi-compartment storage and dispensing container constructed in accordance with an exemplary embodiment.

FIG. 15 illustrates an embodiment of a multi-compartment storage and dispensing container 10 comprising four compartments 40 and a single secondary compartment 48, wherein each compartment 40 and the secondary compartment 48 is adapted with one or more lids 134 in a sliding connection with compartment(s) 40 and or compartment 48. The container of FIG. 15 may be provided with or without the lid or cover 110. The write-on surface 80 is also provided in this embodiment. Furthermore, the above described write-on surface 127 can be also provided.

Figure 16:
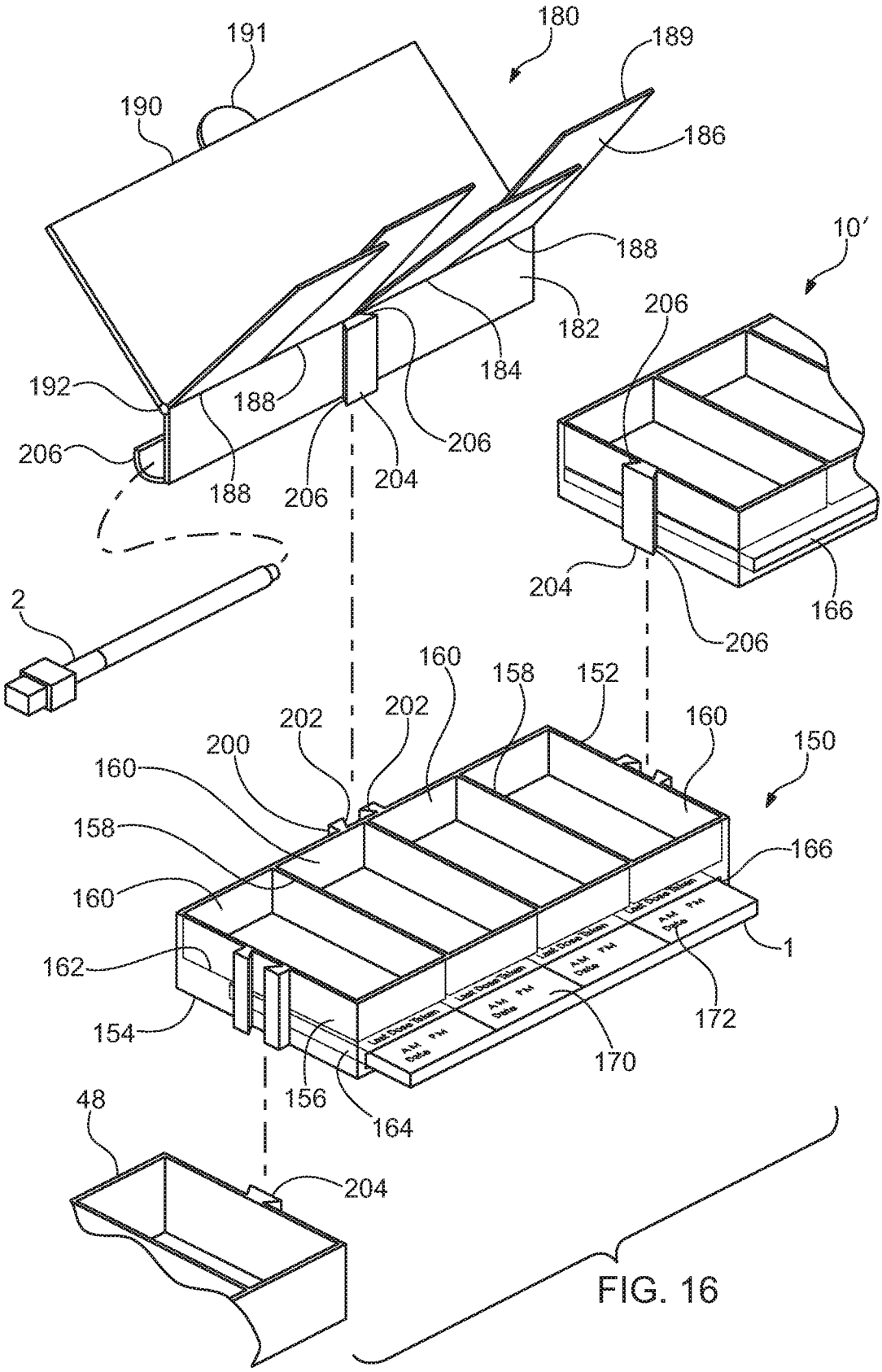
FIG. 16 illustrates a 3-D view of a multi-compartment storage and dispensing container constructed in accordance with an exemplary embodiment.

FIG. 16 illustrates an embodiment of a multi-compartment storage and dispensing container 150 that has a separate housing member with a plurality of lids being hinged thereto and a tapered coupling arrangement so as to removeably or detachably attach the lid member to the housing. This container 150 also includes tapered coupling arrangement on one or more sides for coupling several containers together in a serial manner. The compartment for writing implement 2 is located on the exterior surface of the separate member.

In a closer inspection of FIG. 16, the container 150 comprises a housing 152 with a closed bottom end 154 and a peripheral wall 156 upstanding on the closed bottom end 154. Partitions 158 are also provided and define compartments 160. The container 150 is illustrated in FIG. 16 as comprising four compartments 160, although more or less compartments 160 are also contemplated herewithin. The compartments 160 define a bottom member 162 which is spaced a distance from the inner surface of the closed bottom end 154 to define a hollow portion or a space 164.

The housing 152 also comprises an opening 166 in a portion of the peripheral wall 156, which is a front portion of the container 150. The opening 166 allows access into the hollow interior or space 164 and is illustrated as defining a narrow slot adjacent the closed bottom end 154.

The container 150 also comprises a tray member 170 sized and shaped to move in and out from the hollow interior or space 164 through the opening 166. Essentially the tray member 170 is illustrated as only comprising a first portion 52 of the tray member 50 of FIGS. 1-15. A write-on surface 172 may be coupled, for example by way of an adhesive, to an upper surface of the tray member 170 and include pre-printed indicia. The write-one surface 172 may be essentially identical to the above described write-on surface 80. Tray member 170 may be also provided as being manufactured from a dry-erase material, essentially integrating the write-on surface 172. The front edge of the tray member 170 may extend outwardly past the exterior wall surface of the housing 152 for ease of manual movement or a separate pull tab (not shown) can be provided. The tray member 170 and the housing 152 can be also optionally adapted with the above described notches 90, 96 and tabs 94, 98 and 100. Plurality of write-on surfaces 172 may be provided, each aligned with a respective compartment 160.

The container 150 also comprises a lid or cover assembly 180 that is releasably coupled to the housing 152. The lid or cover assembly 180 comprises a base member 182. In an example, the lid or cover assembly 180 comprises plurality of lids 186 that have a hinged connection 188 with an edge 184 of the base member 182. Each lid 186 is configured to selectively cover and uncover a respective compartment 160. Such hinged connection is illustrated as being of a living hinge type but could be any other hinged connection. At least some of the lids 186 can be adapted with a write-on surface 189, similarly to the embodiments of FIGS. 1-14. In an example, the lid or cover assembly 180 comprises a lid 190 that has a hinged connection 192 with an edge 184 of the base member 182. The lid 190 is configured to selectively cover and uncover all compartments 160, in a similar or identical manner as the above described cover 110. Such hinged connection is illustrated as being of a living hinge type but could be any other hinged connection. In an example, the lid or cover assembly 180 comprises both the lids 186 and the lid 190 configured to cover selectively cover and uncover the lids 186. This may be advantageous when one or more lids 186 are adapted with the write-on surface 189.

The container 150 also comprises a coupling connection between the housing 152 and the lid assembly 180. By way of an example only, the housing 152 can be adapted with a pair of members 200 spaced apart from each other in the exterior surface of the peripheral wall 156, each having an inwardly oriented tapered edge 202. This portion of the peripheral wall 156 can be referred to as a rear portion. The base member 182 is adapted with a member 204 having a pair of opposite tapered edges 206. The member 204 with the pair of opposite tapered edges 206 is sized to mate with the tapered edges 202 of the members 200. In operation the user simply inserts one end of the member 204 into the opening between tapered edges 202 of the members 200 and continues to move the lid assembly 180 downwardly in relationship to the housing 150. The hinge connection 188 and/or 192 can be configured to provide a stop for the lid assembly 180. It will be understood that the positions of the members 200 and member 204 can be reversed.

The writing implement holder can be provided by a concavely shaped member 206 disposed on an exterior surface of the base member 182 and spanning a length thereof, either continuously or in portions. In other words, one or more concavely shaped member 206 can be used. Writing implement holder can be also provided as a pair of C-shaped clips (not shown).

It is also contemplated that members 200 or member 204 can be provided on one or both exterior side surface portions of the peripheral wall 156 to provide a modular assembly of one or more additional containers 150 adapted with complimentary member 204 or members 200. It is also contemplated that two members 200 can be provided on one side surface of the peripheral wall 156 and the member 204 can be provided on an opposite side surface portion of the peripheral wall 156.

Other container(s) 150 can be provided with same or different number of compartments 160 as the container 150 illustrated in FIG. 16. Furthermore, other container(s) 150 can be provided with the lids 120 and cover 110 of FIGS. 1-14 or the sliding type lids 130 of FIG. 15.

It is further contemplated that a single compartment 208 with or without the above described lids can be adapted with the member 204 or members 200 for a releaseable coupling to the container 150 of FIG. 16.

Figure 17:
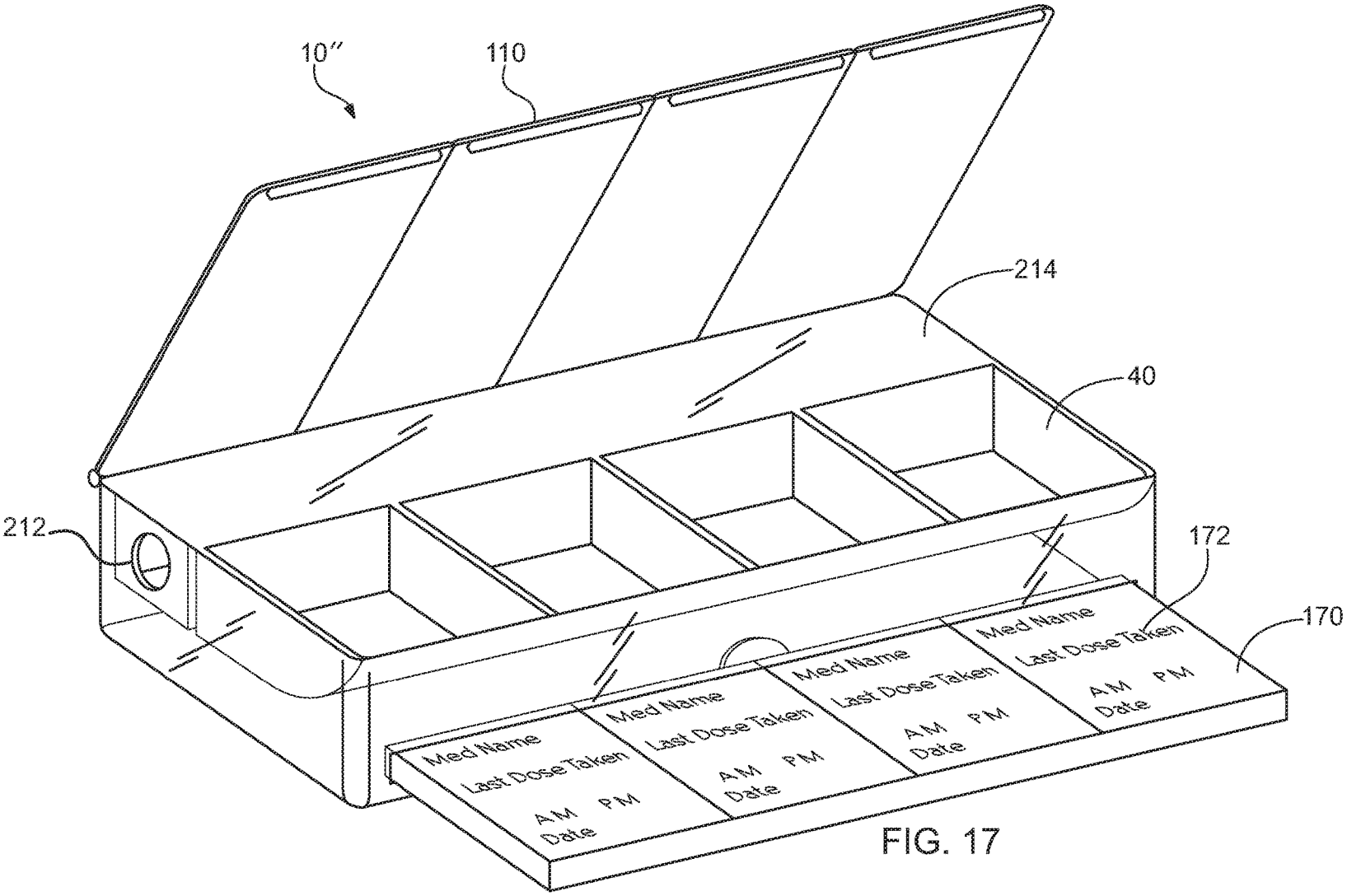
FIG. 17 illustrates a 3-D view of a multi-compartment storage and dispensing container of FIG. 1 constructed in accordance with an exemplary embodiment.

FIG. 17 illustrates an embodiment of a multi-compartment storage and dispensing container 10" that comprises a writing implement holder defining an opening 212 in the peripheral wall and a closed compartment or a well 214 disposed within the hollow interior 32 in an open communication with the opening 212. The well 214 can be a closed chamber. The well or chamber 214 can be provided by the above described member 70. The tray member could be the above described member 50 with the write on-surface 80 or the described tray member 170 with the write-on surface 172.

Figure 18:
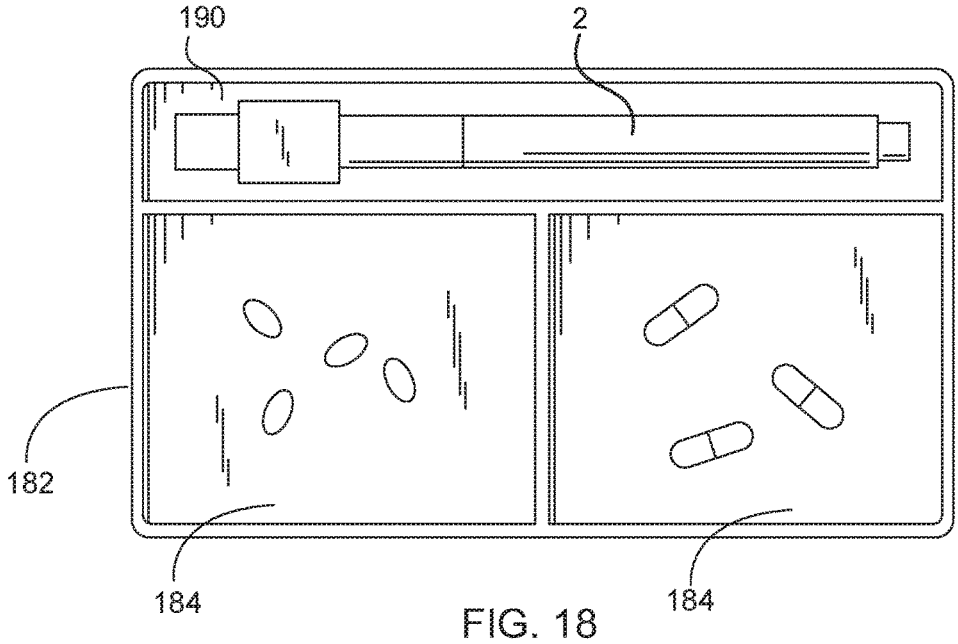
FIG. 18 illustrates a 3-D view of a medicine storage and dispensing container constructed in accordance with an exemplary embodiment.
Figure 19:
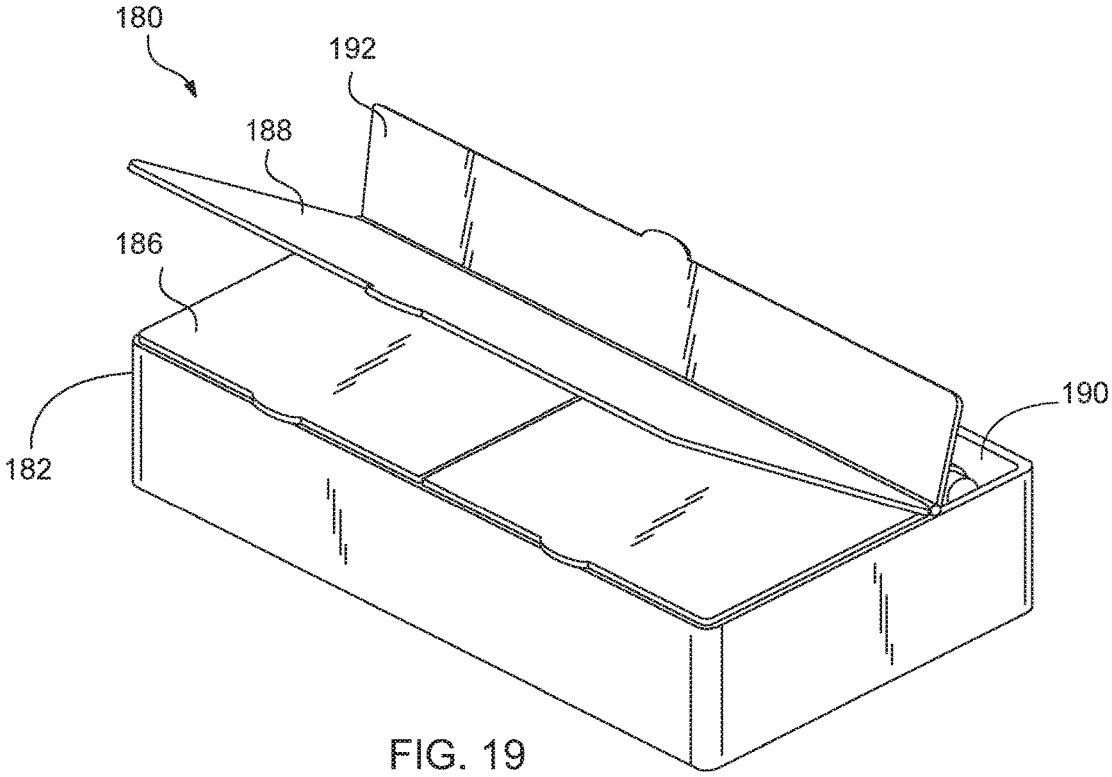
FIG. 19 is a top view of the container of FIG. 18 with covers or lids removed.

FIGS. 18-19 illustrate an embodiment of a container 180 that can be configured as a multi-compartment travel medicine container, being designed for people to travel with one or more different meds, although people may use them in different ways. The container 180 comprises a housing 182. The bottom, right side, left side and rear surfaces of the housing 182 can be flat. Container 180 also comprises a pair of compartments 184 configured for receiving the medicine. Each compartment 184 can be used to store medicine of one specific type or can be used to store medicine either of a same type or mixed types for one day. Each compartment 184 can be adapted with a lid 186 in a hinged connection with the housing 182. The hinged connection of the hinged lid 186 may comprise a living hinge. The lid 186 may be further adapted with a write-on surface (not shown) in concert with any of the above described embodiments. A clear or opaque lid 188 may be also provided in a hinged connection with the housing 182. The hinged connection may comprise a living hinge. A writing implement compartment 190 with a hinged cover 192 is positioned behind the compartments 184.

The write-on surface 80, 127 may be fabricated from a material that does not adhere or bind to the user-adhereable indicia 84, 129, including, without limitation, a dry-erase surface, a melamine surface, porcelain, painted steel, and hardened laminate. The write-on surface 80, 127 is preferably configured to be reused a multiplicity of times to reflect subsequent dosages of the medicine. The user-adhereable indicia 84, 129 is configured to adhere to the write-on surface 80, 127 without binding and/or being absorbed thereby. In some embodiments, the user-adhereable indicia 84, 129 may include, without limitation, a dry-wipe marker ink, an erasable ink, eraser mate inks, and toulene and xylene based inks. In some embodiments, the user-adhereable indicia 84, 129 may be a nontoxic erasable ink that easily and quickly erases from the write-on surface 80, 127. In an embodiment, the identifier 120 may be provided as a peelable label. In an embodiment, the user reapplies any subsequent new user-adhereable indicia 84, 129 without concern for intermeshing the new user-adhereable indicia 84, 129 with a previously applied user-adhereable indicia 84, 129, providing that the user first removes the previously applied user-adhereable indicia 84, 129.

The elongated compartment or compartments 48 at the back of the housing 20 is for prn (as needed meds—unscheduled, primarily used for pain, anxiety, and sleep). It provides a place to hold and distinguish "as needed meds".

In an embodiment, a storage and dispensing container comprises a housing including a bottom end and a peripheral wall upstanding on the bottom end and having an opening, the bottom end and the peripheral wall defining, in a combination with each other, a generally open top end and a hollow interior of the housing; one or more compartments defined within the hollow interior and having a bottom wall thereof spaced apart from an interior surface of the bottom end; a tray member having a first portion thereof positionable within a space between the bottom wall of the one or more compartments and having a second portion thereof upstanding on a front edge of the first portion, wherein the first portion is movable between a retracted position and an extended position and whereby the second portion covers the opening in the peripheral wall when the first portion is in the retracted position; tabs provided on an interior surfaces of the first and second portions of the tray member and defining an open cage sized and shaped to receive a writing implement therewithin; a write-on surface provided on an interior surface of the first portion; and means for preventing an unintentional removal of the first portion from the space.

In an embodiment, a multi-compartment medicine storage and dispensing container aids people in successful transitioning from a hospital or pharmacy environment to a home care environment by "mimicking" the way medications are given. In an effort to reduce hospital re-admissions and reduce healthcare costs, the multi-compartment medicine storage and dispensing container functions as a teaching tool in medicine storage, dispensing and consumption.

In an embodiment, "Last Dose Given" or "Last Dose Taken" is the time that is recorded immediately after medication consumption. The words "Last Dose Given", "Last Dose Taken", "am", "pm" and the date can be pre-printed on the write-on surface 80 and guide the user to avoid any confusion concerning the time that should be recorded.

In an embodiment, a multi-compartment medicine storage and dispensing container maintains medication, directions and record keeping elements in one place.

In an embodiment, the multi-compartment medicine storage and dispensing container aids in preventing medication over- and under-dosing by way of a specific record keeping.

In an embodiment, a multi-compartment medicine storage and dispensing container includes a movable tray with a writing surface thereon.

In an embodiment, a multi-compartment medicine storage and dispensing container includes a pull-out tray or drawer providing access to a hand-written or preprinted card with a protective sleeve.

In an embodiment, a multi-compartment medicine storage and dispensing container includes a hinged lid selectively covering and uncovering an entire open end of the container.

In an embodiment, a multi-compartment medicine storage and dispensing container includes hinged lids for each individual compartment.

In an embodiment, multi-compartment medicine storage and dispensing container includes a writing implement.

In an embodiment, a multi-compartment medicine storage and dispensing container is usable for storing different medications in a single compartment prescribed for a daily intake.

In an embodiment, multi-compartment medicine storage and dispensing container is configured to separately store medicine for each day of a calendar week.

In an embodiment, a multi-compartment medicine storage and dispensing container allows tracking of a "Last Dose Given" or a "Last Dose Taken" during traveling.

In an embodiment, a multi-compartment medicine storage and dispensing container includes a clear protective lid on the upper surface to prevent smudging of the writing surface and ease of determining the "Last Dose Taken" information.

In an embodiment, a multi-compartment medicine storage and dispensing container may be configured for a 7-day consumption keeping medicine, medicine directions, medicine description and medicine recording information all in one place, and potentially can avoid or avoids medicine confusion.

In an embodiment, a multi-compartment medicine storage and dispensing container for a 7-day consumption comprises a separate compartment or compartments for non-prescription medications to be taken on "as needed", (known as prn meds in the medical industry) unscheduled basis so as to prevent accidental over dosage. These medications are primarily, but not limited to, pain, anxiety, and sleep. Last Dose Taken information may particularly benefit patients taking "as needed" drugs due to the desire/need to eliminate symptoms.

In an embodiment, a multi-compartment storage and dispensing container may be configured to store and dispense fasteners, for example such as threaded fasteners, with the write-on surface(s) being advantageous in clearly identifying each threaded fastener, particularly when fasteners with English and metric threads are used.

In an embodiment, a multi-compartment storage and dispensing container may be configured to store sewing In an embodiment, a multi-compartment storage and dispensing container may comprise compartments that slide out and that have write-on surface on all sides.

In an embodiment, a multi-compartment storage and dispensing container may comprise a write-on dry-erase cover that snaps onto a lid of each compartment.

In an embodiment, a multi-compartment storage and dispensing container may comprise a write-on surface on the bottom surface of the housing with a compartmentalized tray manufactured from a clear material and a snap on lid.

In an embodiment, a multi-compartment storage and dispensing container may comprise a grove for removeably or detachably storing or securing a writing implement.

In an embodiment, a multi-compartment storage and dispensing container may comprise an open top end wherein each compartment 40 can be individually removed from the housing and wherein the writing implement is secured on the front surface of the housing with a pair of tabs.

In an embodiment, a multi-compartment storage and dispensing container may comprise compartments that are provided as a unitary member that snaps onto a base having a writing surface thereon and wherein the writing implement is removeably attached to the base.

In an embodiment, a multi-compartment storage and dispensing container may comprise each compartment being adapted with a slideable lid.

In an embodiment, a multi-compartment storage and dispensing container may comprise each compartment being adapted for a sliding snap in movement with the writing implement cage of housing provided on the exterior side surface of the housing.

In an embodiment, a multi-compartment storage and dispensing container may comprise a write-on surface being hinged to the compartment housing.

In an embodiment, a multi-compartment storage and dispensing container may comprise a pair of write-on surfaces and pull-out type compartments.

In an embodiment, a multi-compartment storage and dispensing container may comprise a forward flip write-on surface, individual compartment lid and an opening for a removable storage of a writing implement.

In an embodiment, a multi-compartment storage and dispensing container may comprise a pair of hinged lids, wherein the writ-on surface is provided on an inner lid and a recess for a writing implement is provided at the rear of the housing.

In an embodiment, a multi-compartment storage and dispensing container may comprise a slot for a pull-out write-on surface and a recess for a writing implement is provided at the rear of the housing.

In an embodiment, a multi-compartment storage and dispensing container may comprise a separate write-on surfaces for medicine description and medicine tracking that have hinged connections with the housing.

In an embodiment, a multi-compartment storage and dispensing container may comprise a modular medicine compartment.

In an embodiment, a multi-compartment storage and dispensing container may comprise hinged write-on surface, hinged main lid and a recess for a writing implement is provided at the rear of the housing.

In an embodiment, a multi-compartment storage and dispensing container may comprise a dual flip lid arrangement, a drawer for writing implement storage and a write-on surface.

In an embodiment, a multi-compartment storage and dispensing container may comprise a pull-out shelf-type write-on surface and a hinged door or lid at the rear end of the housing that selectively covers and uncovers compartment for a writing implement.

In an embodiment, a multi-compartment storage and dispensing container may comprise unitary compartment members that slide from the side of the housing.

In an embodiment, a multi-compartment storage and dispensing container may comprise a flip up construction with a pair of write-on surfaces.

In an embodiment, a multi-compartment storage and dispensing container can be configured as a push to open lid, for example as disclosed in U.S. Pat. No. 8,459,459 issued to Noble et al. on Jun. 11, 2003 and whose disclosure is incorporated in its entirety by reference thereto.

In an embodiment, one or more lids, for example lid(s) 120 or lid 130, for multi-compartment storage and dispensing container can be configured as a push to open lid, for example as disclosed in U.S. Pat. No. 7,624,890 issued to Noble et al. on Dec. 1, 2009 and whose disclosure is incorporated in its entirety by reference thereto.

In an embodiment, a multi-compartment storage and dispensing container may comprise a roll type wherein each compartment is hingeably attached to another compartment along a length thereof and is shaped in a cross-section such that the compartments can be rolled into a closed position securable with a clasp and providing an axial aperture for removeably storing a writing implement.

When the multi-compartment container is provided as a travel medicine storage and dispensing container, provisions for housing writing implement 2, either inside or outside of the container and write-on surface(s) 80 and/or 127 provide a self-contained assembly allowing the user of the travel medicine container to accurately record the medicine information and medicine consumption.

In an embodiment, a method of tracking medicine consumption comprises providing a multi-compartment container with compartments for storing medicine, a movable tray member having a first write-on erasable surface, a writing implement holder and a hinged or slideable lid on each compartment with a second write-on erasable surface; placing medicine in each compartment; writing, with a writing implement, on the first write-on erasable surface medicine identification information; writing, with a writing implement, on the second write-on erasable surface medicine consumption information; dispensing medicine from a selected compartment; erasing, either partially or completely, medicine consumption information on a second write-on erasable surface of the selected compartment; writing new medicine consumption information on a second write-on erasable surface of the selected compartment; and repeating the previous steps to consume medicine in one or more compartments. The method may further comprise replenishing medicine in one or more compartments and modifying the medicine consumption and/or medicine identification information as applicable. The method may further comprise providing the writing implement and detachably securing or placing the writing implement in the writing implement holder. The method may further comprise hingeably attaching a single lid to one wall of the container. The method may further comprise providing a coupling arrangement on an exterior surface of the container and attaching one or more other containers of compartments having a complimentary coupling arrangement. The method may further comprise providing seven compartments and using each compartment for a distinct day of the week. The method may further comprise providing multiples of seven compartments for a multi-week medicine consumption and using each compartment for a distinct day of the week.

In an embodiment, a method of tracking medicine consumption comprises providing a multi-compartment container with compartments for storing medicine, a writing implement storage compartment, a movable tray member having a first write-on erasable surface and a hinged or slideable lid on each compartment with a second write-on erasable surface; placing medicine in each compartment; writing, with a writing implement, on the first write-on erasable surface medicine identification information; writing, with a writing implement, on the second write-on erasable surface medicine consumption information; dispensing medicine from a selected compartment; erasing, either partially or completely, medicine consumption information on a second write-on erasable surface of the selected compartment; writing new medicine consumption information on a second write-on erasable surface of the selected compartment; and repeating the previous steps to consume medicine in one or more compartments. The method may further comprise replenishing medicine in one or more compartments and modifying the medicine consumption and/or medicine identification information as applicable. The method may further comprise providing the writing implement and placing the writing implement in the writing implement storage compartment. The method may further comprise hingeably attaching a single lid to one wall of the container. The method may further comprise providing a coupling arrangement on an exterior surface of the container and attaching one or more other containers of compartments having a complimentary coupling arrangement.

In an embodiment, a method of tracking medicine consumption comprises providing a multi-compartment container with compartments for storing medicine, a writing implement storage compartment, a movable tray member having a first write-on erasable surface and a detachable lid assembly comprising a lid for each compartment with a second write-on erasable surface; placing medicine in each compartment; writing, with a writing implement, on the first write-on erasable surface medicine identification information; writing, with a writing implement, on the second write-on erasable surface medicine consumption information; dispensing medicine from a selected compartment; erasing, either partially or completely, medicine consumption information on a second write-on erasable surface of the selected compartment; writing new medicine consumption information on a second write-on erasable surface of the selected compartment; and repeating the previous steps to consume medicine in one or more compartments. The method may further comprise replenishing medicine in one or more compartments and modifying the medicine consumption and/or medicine identification information as applicable. The method may further comprise providing the writing implement and placing the writing implement in the writing implement storage compartment. The method may further comprise providing a coupling arrangement on an exterior surface of the container and attaching one or more other containers of compartments having a complimentary coupling arrangement.

The chosen exemplary embodiments of the claimed subject matter have been described and illustrated, to plan and/or cross section illustrates that are schematic illustrations of idealized embodiments, for practical purposes so as to enable any person skilled in the art to which it pertains to make and use the same. As such, variations from the shapes of the illustrations as a result, for example, of manufacturing techniques and/or tolerances, are to be expected. It is therefore intended that all matters in the foregoing description and shown in the accompanying drawings be interpreted as illustrative and not in a limiting sense. For example, a region illustrated or described as flat may, typically, have rough and/or no linear features. Moreover, sharp angles that are illustrated may be rounded. Thus, the regions illustrated in the figures are schematic in nature and their shapes are not intended to illustrate the precise shape of a region and are not intended to limit the scope of the present claims.

It will be understood that variations, modifications, equivalents and substitutions for components of the specifically described exemplary embodiments of the invention may be made by those skilled in the art without departing from the spirit and scope of the invention as set forth in the appended claims.

In an example only, the above described container(s) may be employed for storing any substance such as dry or wet ingredients and/or fluids so that the user can for example record an expiration date of such substance. In an example, the type and/or quantity of the substance contained within the container can be recorded on the write-on surface(s).

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by terms. These terms are only used to distinguish one element, component, region, layer, or section from another element, component, region, layer or section. Thus, "a first element," "component," "region," "layer," or "section" discussed below could be termed a second element, component, region, layer, or section without departing from the teachings herein.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceding specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible.

Furthermore, the Abstract is not intended to be limiting as to the scope of the claimed invention and is for the purpose of quickly determining the nature of the claimed invention.

What is claimed is:

1. A storage and dispensing container, comprising:

a housing including a bottom end and a peripheral wall upstanding on said bottom end, said peripheral wall having a wall portion with an opening, said bottom end and said peripheral wall defining, in a combination with each other, a generally open top end and a hollow interior of said housing;

a plurality of compartments defined within said hollow interior and being separated from each other with a partition;

lids;

a hinged connection between an edge of each lid from said lids and an edge portion of each compartment from said plurality of compartments so that said each lid is configured to selectively cover and uncover an open end of said each compartment;

a write-on erasable surface on an exterior surface of one or more lids from said lids;

a space between a bottom wall of said one or more compartments and an interior surface of said bottom end;

a tray member movable, within said space and through said opening, between a retracted position where said tray member is disposed within said space and an extended position, where said tray member extends outwardly from said peripheral wall; and a writing implement holder being sized and shaped to receive a writing implement therewithin.

2. The storage and dispensing container of claim 1, further comprising a write-on erasable surface disposed on said tray member.

3. The storage and dispensing container of claim 1, further comprising a lid and a hinged connection between one edge of said lid and an edge portion of said peripheral wall so that said lid is configured to selectively cover and uncover said open top end of said housing.

4. The storage and dispensing container of claim 1, wherein said tray member comprises a first portion positionable within said space between said bottom wall of said one or more compartments and said interior surface of said bottom end and a second portion thereof upstanding on a front edge of said first portion, said second portion covers said opening in said peripheral wall when said first portion is disposed in said retracted position.

5. The storage and dispensing container of claim 4, further comprising a pair of first notches formed through a thickness of said first portion in an open communication with a rear edge thereof, a pair of first tabs extending outwardly from side edges of said first portion adjacent said rear edge thereof, a pair of second notches formed through said thickness of said first portion adjacent said front edge thereof, a pair of second tabs extending outwardly from said side edges of said first portion adjacent said front edge thereof, and a pair of third tabs provided on inner surfaces of said peripheral wall in an operative alignment with said pairs of first and second tabs so that said pairs of first and second tabs move, upon application of a manual force, inwardly to allow at least a partial insertion of said first portion into said space or a partial removal of said first portion from said space.

6. The storage and dispensing container of claim 2, wherein said write-on surface on said tray member comprises a removable member held in a working position on an interior surface of said tray member by one or more tabs provided at a rear edge of said tray member.

7. The storage and dispensing container of claim 1, wherein said tray member comprises a portion that covers said opening when said tray member is disposed within said space, and wherein said writing implement holder comprises tabs provided on an interior surface or surfaces of said tray member and defining said open compartment, said tabs comprising two end tabs disposed in a spaced apart relationship with each other and another tab disposed in a space between said two end tabs and at a distance from an inner surface of said portion of said tray member.

8. The storage and dispensing container of claim 1, further comprising one or more additional compartments oriented transverse to said plurality of compartments.

9. The storage and dispensing container of claim 8, further comprising at least one other lid and a hinged connection between an edge of said at least one other lid and an edge portion of at least one of said one or more additional compartments, said at least one other lid is configured to selectively cover and uncover an open end of said at least one of said one or more additional compartments.

10. The storage and dispensing container of claim 1, wherein said writing implement holder comprises a well within said hollow interior and an opening in said peripheral wall, said well being in an open communication with said opening.

11. The storage and dispensing container of claim 1, further comprising a lid assembly and a coupling connection configured to releasably couple said lid assembly to said housing.

12. The storage and dispensing container of claim 11, wherein said lid assembly comprises a base member and one or more lids in a hinge connection with said base member.

13. The storage and dispensing container of claim 11, wherein said coupling connection comprises a pair of members spaced apart from each other on an exterior surface of said peripheral wall, each having an inwardly oriented tapered edge, and a member disposed on a surface of said base member and comprising a pair of opposite tapered edges sized to mate with said tapered edges of said members on said exterior surface of said peripheral wall.

14. The storage and dispensing container of claim 1, wherein said one or more compartments comprises a plurality of compartments disposed in a series with each other along said portion of said side wall having said opening therethrough.

15. The storage and dispensing container of claim 1, wherein said writing implement holder is disposed within said tray.

16. A medicine storage and dispensing container, comprising:

a housing including a bottom end and a peripheral wall upstanding on said bottom end and having an opening, said bottom end and said peripheral wall defining, in a combination with each other, a generally open top end and a hollow interior of said housing;

one or more compartments defined within said hollow interior;

a space between a bottom wall of said one or more compartments and an interior surface of said bottom end;

a tray member having a first portion thereof positionable within said space between said bottom wall of said one or more compartments and said interior surface of said bottom end, said tray member further having a second portion thereof upstanding on a front edge of said first portion, wherein said tray member is movable between a retracted position where said first portion is disposed within said space and said second portion covers said opening and an extended position where said first and second portions extends outwardly from said peripheral wall;

a writing implement holder comprising tabs provided on an interior surfaces of said first and second portions of said tray member and defining an open compartment sized and shaped to receive a writing implement therewithin;

a write-on surface provided on an interior surface of said first portion;

a pair of first notches formed through a thickness of said first portion in an open communication with a rear edge thereof, a pair of first tabs extending outwardly from side edges of said first portion adjacent said rear edge thereof, a pair of second notches formed through said thickness of said first portion adjacent said front edge thereof, a pair of second tabs extending outwardly from said side edges of said first portion adjacent said front edge thereof, a pair of third tabs provided on inner surfaces of said peripheral wall in an operative alignment with said pairs of first and second tabs so that said pairs of first and second tabs move, upon application of a manual force, inwardly to allow at least a partial insertion or a partial removal of said first portion from said space; and at least one lid configured to selectively open and close at least one compartment.

17. The storage and dispensing container of claim 16, wherein said one or more compartments is a plurality of compartments and wherein said storage and dispensing container further comprising lids and a sliding connection between an edge of each lid and each compartment so that said each lid is configured to selectively cover and uncover an open end of each compartment.

18. The storage and dispensing container of claim 16, further comprising a pair of members spaced apart from each other on an exterior surface of said peripheral wall, each having an inwardly oriented tapered edge or a single member having a pair of opposite tapered edges sized to mate with said tapered edges.

19. A storage and dispensing container, comprising:

a housing including a bottom end and a peripheral wall upstanding on said bottom end, said peripheral wall having an opening, said bottom end and said peripheral wall defining, in a combination with each other, a generally open top end and a hollow interior of said housing;

one or more compartments defined within said hollow interior and being separated from each other with a side wall;

a space between a bottom wall of said one or more compartments and an interior surface of said bottom end;

a tray member movable, within said space and through said opening, between a retracted position where said tray member is disposed within said space and an extended position, where said tray member extends outwardly from said peripheral wall, said tray member comprises:

a first portion positionable within said space between said bottom wall of said one or more compartments and said interior surface of said bottom end, a second portion thereof upstanding on a front edge of said first portion, said second portion covers said opening in said peripheral wall when said first portion is disposed in said retracted position, a pair of first notches formed through a thickness of said first portion in an open communication with a rear edge thereof, a pair of first tabs extending outwardly from side edges of said first portion adjacent said rear edge thereof, a pair of second notches formed through said thickness of said first portion adjacent said front edge thereof, and a pair of second tabs extending outwardly from said side edges of said first portion adjacent said front edge thereof;

a pair of third tabs provided on inner surfaces of said peripheral wall in an operative alignment with said pairs of first and second tabs so that said pairs of first and second tabs move, upon application of a manual force, inwardly to allow at least a partial insertion of said first portion into said space or a partial removal of said first portion from said space; and a writing implement holder being sized and shaped to receive a writing implement therewithin.

20. The storage and dispensing container of claim 19, wherein said one or more compartments is a plurality of compartments and wherein said storage and dispensing container further comprises lids and a hinged connection between an edge of each lid from said lids and an edge portion of each compartment from said plurality of compartments so that said each lid is configured to selectively cover and uncover an open end of said each compartment.

21. The storage and dispensing container of claim 20, further comprising a write-on erasable surface on an exterior surface of one or more lids from said lids.

* * * * *